US007081815B2

(12) United States Patent
Runyon et al.

(10) Patent No.: US 7,081,815 B2
(45) Date of Patent: Jul. 25, 2006

(54) RADIO FREQUENCY SECURITY SYSTEM, METHOD FOR A BUILDING FACILITY OR THE LIKE, AND APPARATUS AND METHODS FOR REMOTELY MONITORING THE STATUS OF FIRE EXTINGUISHERS

(75) Inventors: Larry Runyon, Richland, WA (US); Wayne M. Gunter, Richland, WA (US); Ronald W. Gilbert, Gilroy, CA (US)

(73) Assignee: Battelle Memorial Institute, Richland, WA (US)

( * ) Notice: Subject to any disclaimer, the term of this patent is extended or adjusted under 35 U.S.C. 154(b) by 184 days.

(21) Appl. No.: 10/669,669

(22) Filed: Sep. 23, 2003

(65) Prior Publication Data

US 2004/0070506 A1 Apr. 15, 2004

Related U.S. Application Data

(63) Continuation-in-part of application No. 09/940,142, filed on Aug. 23, 2001, now Pat. No. 6,646,550.

(51) Int. Cl.
*G08B 13/00* (2006.01)

(52) U.S. Cl. ..... 340/541; 340/539.1; 340/539.11; 340/531; 340/540; 340/572.1; 340/572.8; 169/51; 169/60

(58) Field of Classification Search ..... 340/540, 340/541, 539.1, 539.11, 539.31, 539.32, 572.1, 340/572.7, 572.8, 568.1, 691.1, 693.6, 572.4, 340/531; 169/51, 60
See application file for complete search history.

(56) References Cited

U.S. PATENT DOCUMENTS

| | | | | |
|---|---|---|---|---|
| 3,608,715 | A | 9/1971 | Snyder et al. | 209/111 |
| 3,725,891 | A | 4/1973 | Miller | 340/273 |
| 3,763,795 | A | 10/1973 | Wetz, Jr. | 109/41 |
| 3,768,567 | A * | 10/1973 | Weise | 169/26 |
| 3,802,252 | A | 4/1974 | Hayward et al. | 73/52 |
| 4,062,164 | A | 12/1977 | Cousins | 52/489 |
| 4,223,790 | A | 9/1980 | Yoshida | 209/590 |
| 4,234,875 | A | 11/1980 | Williams | 340/550 |
| 4,293,778 | A | 10/1981 | Williams | 340/550 |
| 4,335,375 | A | 6/1982 | Schaeffer | 340/539 |
| 4,538,527 | A | 9/1985 | Kitchen | 109/21 |
| 4,550,311 | A | 10/1985 | Galloway et al. | 340/531 |
| 4,565,088 | A | 1/1986 | Crambes | 73/61 |
| 4,599,831 | A | 7/1986 | Magaha, Jr. | 52/98 |
| 4,722,435 | A | 2/1988 | Mareels et al. | 206/1 |
| 4,821,573 | A | 4/1989 | Nagata et al. | 73/597 |

(Continued)

OTHER PUBLICATIONS http://www.marina-accessories.com/fire_station_safety.shtml, Marina Accessories Webpage NTOUT, "Fire Stations and Safety", 3 pp. (May 16, 2003).

(Continued)

*Primary Examiner*—Hung Nguyen
(74) *Attorney, Agent, or Firm*—Wells St. John P.S.

(57) ABSTRACT

A system for remotely monitoring the status of one or more fire extinguishers includes means for sensing at least one parameter of each of the fire extinguishers; means for selectively transmitting the sensed parameters along with information identifying the fire extinguishers from which the parameters were sensed; and means for receiving the sensed parameters and identifying information for the fire extinguisher or extinguishers at a common location. Other systems and methods for remotely monitoring the status of multiple fire extinguishers are also provided.

39 Claims, 13 Drawing Sheets

U.S. PATENT DOCUMENTS 5,165,465 A 11/1992 Kenet ..... 165/2
5,200,735 A 4/1993 Hines ..... 340/539
5,255,564 A 10/1993 Glad et al. ..... 73/597
5,309,146 A 5/1994 Kenet ..... 340/540
5,404,755 A 4/1995 Olson et al. ..... 73/639
5,457,997 A 10/1995 Naruo et al. ..... 73/643
5,473,934 A 12/1995 Cobb ..... 73/61
5,535,627 A 7/1996 Swanson et al. ..... 73/597
5,559,292 A 9/1996 Hull et al. ..... 73/597
5,572,190 A 11/1996 Ross et al. ..... 340/541
5,600,303 A 2/1997 Husseiny et al. ..... 340/568
5,600,700 A 2/1997 Krug et al. ..... 378/57
5,606,130 A 2/1997 Sinha et al. ..... 73/627
5,608,164 A 3/1997 MacLauchlan ..... 73/599
5,610,583 A 3/1997 Drebika et al. ..... 340/566
5,614,802 A 3/1997 Nilssen ..... 380/20
5,616,856 A 4/1997 Castel ..... 73/61
5,661,802 A 8/1997 Nilssen ..... 380/240
5,677,674 A 10/1997 Wolf ..... 340/541
5,690,114 A 11/1997 Chiang et al. ..... 128/661
5,692,029 A 11/1997 Husseiny et al. ..... 378/88
5,698,787 A 12/1997 Parzuchowski et al. ..... 73/643
5,728,933 A 3/1998 Schultz et al. ..... 73/146.5
5,748,092 A 5/1998 Arsenault et al. ..... 340/604
5,754,498 A 5/1998 Toda ..... 367/137
5,767,407 A 6/1998 Sinha ..... 73/579
5,775,430 A 7/1998 McSheffrey ..... 169/30
5,808,541 A 9/1998 Golden ..... 340/286.05
5,848,651 A 12/1998 McSheffrey et al. ..... 169/51
5,872,314 A 2/1999 Clinton ..... 73/602
5,929,337 A 7/1999 Collins et al. ..... 73/597
5,952,919 A * 9/1999 Merrill ..... 340/539.18
5,974,111 A 10/1999 Krug et al. ..... 378/57
5,979,240 A 11/1999 Rix et al. ..... 73/602
5,999,094 A 12/1999 Nilssen ..... 340/507
6,029,530 A 2/2000 Patton et al. ..... 73/866
6,049,272 A 4/2000 Lee et al. ..... 340/539
6,078,269 A 6/2000 Markwell et al. ..... 340/825
6,094,140 A 7/2000 Parente ..... 340/573
6,104,301 A 8/2000 Golden ..... 340/628
6,125,940 A 10/2000 Oram ..... 169/23
6,234,023 B1 5/2001 Collins et al. ..... 73/597
6,288,637 B1 * 9/2001 Thomas et al. ..... 340/506
6,302,218 B1 10/2001 McSheffrey et al. ..... 169/51
6,311,779 B1 11/2001 McSheffrey et al. ..... 169/23
6,488,099 B1 12/2002 McSheffrey et al. ..... 169/60
6,738,025 B1 5/2004 Carrender ..... 343/860
6,745,008 B1 6/2004 Carrender et al. ..... 455/41.1
6,765,476 B1 7/2004 Steele et al. ..... 340/10.4
6,774,782 B1 8/2004 Runyon et al. ..... 340/505
6,842,106 B1 1/2005 Hughes et al. ..... 340/5.8
6,868,073 B1 3/2005 Carrender et al. ..... 370/278
2002/0149468 A1 10/2002 Carrender et al. ..... 340/5.61
2002/0149484 A1 10/2002 Carrender ..... 340/572.4
2004/0066279 A1 4/2004 Hughes et al. ..... 340/10.1
2004/0066280 A1 4/2004 Pratt et al. ..... 340/10.2
2004/0066752 A1 4/2004 Hughes et al. ..... 370/252
2004/0067764 A1 4/2004 Pratt et al. ..... 455/502
2004/0070500 A1 4/2004 Pratt et al. ..... 340/572.1
2004/0198222 A1 10/2004 Ertin et al. ..... 455/41
2004/0198233 A1 10/2004 Pratt et al. ..... 455/67.11

OTHER PUBLICATIONS http://www.hoyles.com/firepoint.htm, Hoyles Electronic Developments, "Extinguisher Alarm: Firepoint", 2 pp. (May 16, 2003).

U.S. Appl. No. 10/589,001, filed Jun. 6, 2000, R. W. Gilbert et al.

U.S. Appl. No. 09/588,997, filed Jun. 6, 2000, R. W. Gilbert et al.

* cited by examiner

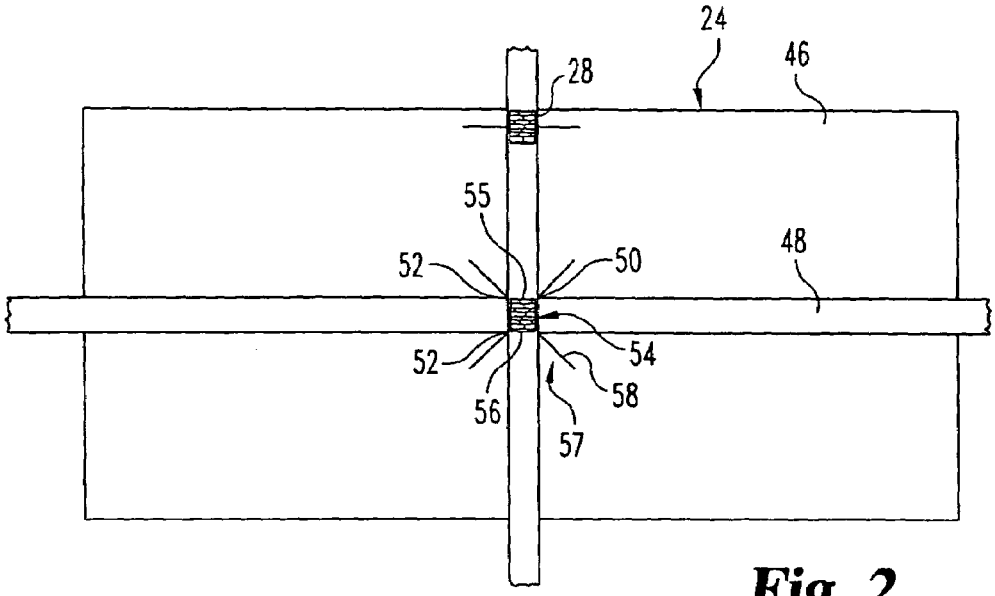
Fig. 2
Fig. 3
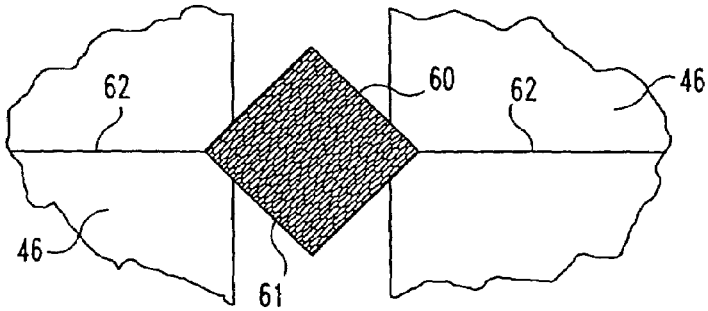
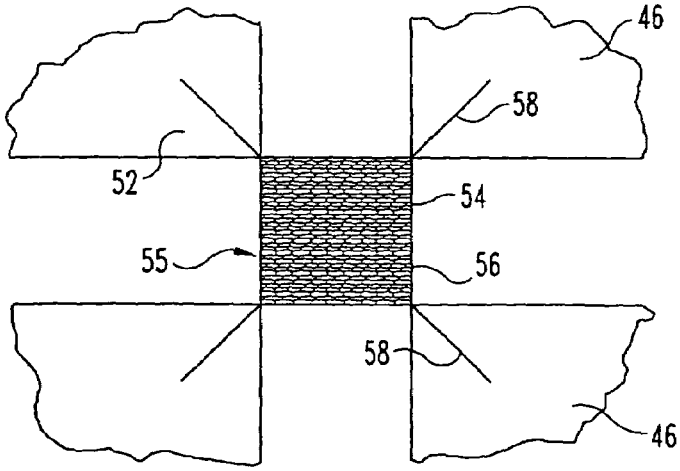
Fig. 4

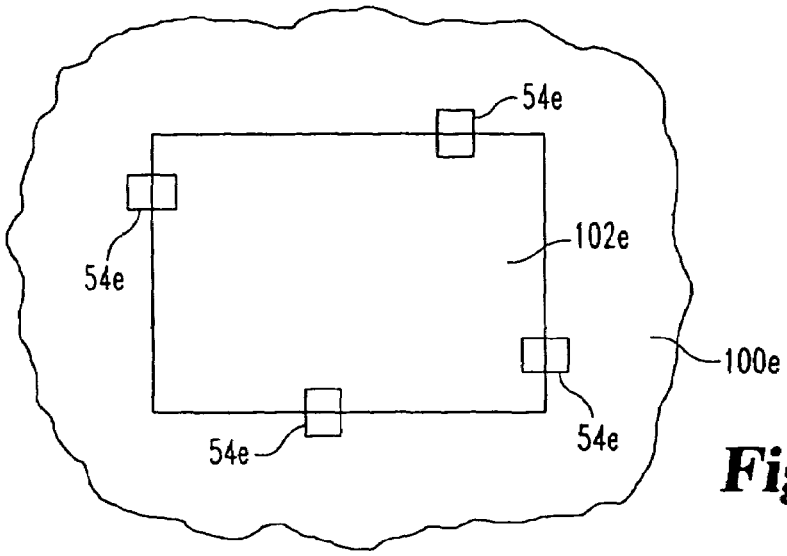
Fig. 10
Fig. 11
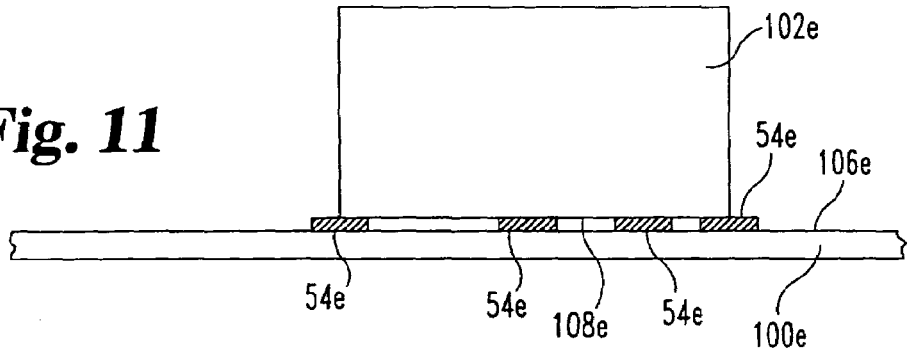
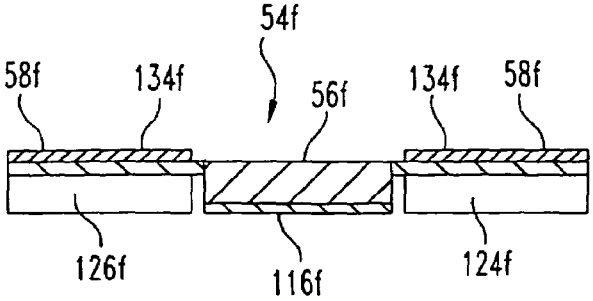
Fig. 12

RADIO FREQUENCY SECURITY SYSTEM, METHOD FOR A BUILDING FACILITY OR THE LIKE, AND APPARATUS AND METHODS FOR REMOTELY MONITORING THE STATUS OF FIRE EXTINGUISHERS

CROSS REFERENCE TO RELATED APPLICATION

This is a continuation-in-part of U.S. patent application Ser. No. 09/940,142, filed Aug. 23, 2001 U.S. Pat. No. 6,646,550, naming as inventors Wayne M. Gunter, Larry Runyon, and Ronald W. Gilbert, and which is incorporated herein by reference.

GOVERNMENT RIGHTS

This invention was made with government support under contract number DE-AC0676RLO1830 awarded by the U.S. Department of Energy. The Government has certain rights in the invention.

TECHNICAL FIELD

Aspects of the invention relate to a system, method and apparatus for maintaining security, and more particularly for maintaining security in an environment such as a building facility where there is a security-sensitive area with security-sensitive objects or items. Other aspects of the invention relate to fire extinguishing systems and methods, and to sensing, monitoring, and remote transmitting apparatus and methods used in connection with fire extinguishing equipment.

BACKGROUND OF THE INVENTION

The standards and requirements for fire extinguishing systems can be an overwhelming management task for Safety/Security Managers, who are responsible for large buildings or facilities. For example, at the Mandalay Hotel in Las Vegas, Nev., there are over 1900 fire extinguishers that require daily oversight and management. When one considers, for example, the following mandatory NFPA standards and requirements associated with fire extinguishers, it becomes readily apparent that the management of these systems in large buildings/facilities can be a monumental task:

1) Ensure fire extinguishers have not been tampered with or illegally removed,
2) Ensure fire extinguishers undergo required monthly, periodic and annual inspections to confirm they are fully charged and operable,
3) Ensure fire extinguishers undergo scheduled maintenance/testing (annual hydrostatic and conductivity testing, system recharging, etc.), and
4) Ensure fire extinguisher record keeping/documentation is completed.

Various fire extinguisher apparatus have been heretofore proposed. For example, U.S. Pat. No. 6,125,940 to Oram (incorporated herein by reference) discloses a pressure indicating system for fire extinguishers whereby an audio alarm is sounded if the fire extinguisher is overcharged or undercharged. A visual indicator displaying the amount of pressure is also provided.

U.S. Pat. No. 5,775,430 to McSheffrey (incorporated herein by reference) discloses a portable fire extinguisher, a valve assembly, and a gauge displaying the pressure condition of the fire extinguisher. An electronic circuit issues a signal in response to a condition, such as low pressure in the tank, smoke, lack of light, lack of external power, low battery, or lack of inspection reset within a predetermined amount of time. Attention is also directed to the following patents to McSheffrey et al. which disclose similar systems and improvements and which are incorporated herein by reference: U.S. Pat. Nos. 5,848,651; 6,302,218; 6,311,779; and 6,488,099.

U.S. Pat. Nos. 5,808,541, and 6,104,301, both to Golden (and both incorporated herein by reference), disclose an automatic fire suppression system having an electronic processor capable of monitoring system function, pressure, power level, and power source. A fire sensor and an audible or visual alarm are coupled to the processor. A valve is opened and the alarm is activated if the sensor detects a fire. A remote transmitter can be used to allow the system to be activated and the valve opened from a location remote from the hazard. A GPS device can be coupled to the processor and the location of the device can be communicated to a remote operator in the event that the presence of a fire is detected.

U.S. Pat. No. 5,728,933 to Schultz et al. (incorporated herein by reference) discusses, among other things, the problem of determining if all the fire extinguishers in a building are properly charged. It discloses (starting, for example, at Col. 11, line 9) a remote sensing and receiving system that may be employed in fire extinguisher devices. A remote sensor unit, attached to a fire extinguisher device, communicates with a receiver unit 500 through infrared signals. The sensor unit must be capable of transmitting data, to the receiver unit, indicative of identification of the fire extinguisher. The sensor unit stores information in memory, such as building address, date of filling, filling sight, barometric pressure at filling sight, device identification number, and location inside the building. Pertinent information for extinguisher maintenance and inspection could be stored in memory. In the normal course of building maintenance, an inspector holding a receiver unit periodically walks up to the fire extinguisher device and presses appropriate keys on a keyboard in order to activate the sensor unit. The sensor unit is turned on and transmits signals indicative of characteristics of the fire extinguisher device and the sensor unit. Such characteristics include current pressure in the extinguisher, identification of the fire extinguisher, date of charging, as well as other data stored by the sensor unit.

A commercial product, Fire Extinguisher Theft Stopper™, sounds an audio alarm when a fire extinguisher is removed from a designated position.

A fire extinguisher system is needed having improved sensing of fire extinguisher parameters and/or to assist with management of fire extinguisher systems.

SUMMARY OF THE INVENTION

Some embodiments of the present invention provide a method arranged to reduce security risks in or adjacent to a building facility where there are in, or proximate to, the building facility components which comprise one or more (or more than one) of the following:

a) building component(s) which are part of, or associated with, a building of the building facility;
b) facility component(s) which are in or adjacent to the building and relate to functions or occupancy of the building facility;

c) other component(s) which are in or adjacent to the building facility that are not included in building components or facility components.

Each of these components is further categorized as follows:

a) security-sensitive components which comprise:
   I. component(s) which themselves are security-sensitive (i.e. because of having or containing security-sensitive information or items or components which are of sufficient value to be security-sensitive);
   II. component(s) which are of a nature that if moved or otherwise tampered with in some manner such tampering may indicate a security risk;
   III. components which are both themselves security-sensitive and also are of a nature that if moved or otherwise tampered with in some manner such tampering may indicate a security risk;
b) non-security-sensitive component(s), which include the items or components which are not security-sensitive.

In some embodiments, the method comprises providing at least one tamper-indicating device which in turn comprises a tamper-responsive section which comprises at least one tamper-responsive portion which has an intact condition and a non-intact condition. In a preferred form of the present invention, this tamper-responsive portion has an electrically conductive portion which in the intact position is able to conduct electricity between first and second tamper related locations, and in the non-intact position is not able to conduct electricity between the first and second tamper related locations.

Also, in some embodiments, the tamper-indicating device comprises a signaling section that is operatively connected to the tamper-responsive section in a manner to:

a) provide a signal indicating at least one of;
   I. a non-intact condition;
   II. an intact condition; or
b) not provide a signal in response to an interrogating signal to indicate:
   I. a non-intact condition; or
   II. an intact condition The tamper-indicating device is placed in a security risk detecting position by operatively engaging the tamper-indicating device to two of said components, at least one of which is a security-sensitive component. The two components are characterized in that relative movements between the two components indicates a possibility of a security risk occurrence. The tamper-indicating device is arranged and connected to the two components so that relative movement between the two components causes a break or damage to the tamper-responsive section to cause the tamper-responsive section to go to its non-intact condition.

Then a signal receiving device is operated to ascertain either a reception of a signal or a lack of reception of a signal from the tamper-indicating device to ascertain the possible security risk occurrence. In some embodiments of the present invention, the tamper-indicating device transmits its tamper-indicating signal in response to the tamper-responsive section going to its non-intact condition. The tamper-indicating device has a sleep mode which exists so long as the tamper-responsive section is in its intact position. The tamper-indicating device is caused to go from the sleep mode to an active mode upon occurrence of the tamper-responsive section going to its non-intact condition to in turn to cause the tamper-signaling section to transmit the tamper-indicating signal. In the preferred embodiment the electrically conductive portion in the intact position causes the tamper-indicating device to remain in its sleep mode and in the non-intact position causes the tamper-indicating device to go to its active mode.

In a preferred form, the electrically conductive portion is operatively connected to circuitry of the tamper-signaling section in a manner that with the electrically conductive portion in its intact position, an input to a micro-controller of said tamper-signaling section is at a first voltage level. Then with the electrically conductive portion in its non-intact position, the input to the micro-controller is at another voltage level, with the change from the first voltage level causes the micro-controller to place the tamper-signaling section into its active mode.

In another embodiment of the present invention, interrogating signals are transmitted to the tamper-indicating device, and the tamper-indicating device modulates the signal in response to the interrogating signal so that a modulated response is transmitted when there is an intact condition of the tamper-responsive section. When a non-intact condition exists, the modulated signal is not transmitted, thus indicating a possibility of a security risk.

Also in some embodiments, the tamper-indicating device with the tamper-responsive section in its intact position is energized by an interrogating signal to provide a modulated response. With the tamper-responsive section in its non-intact position, the tamper-responsive device does not send the modulated response. In a specific form, the electrically conductive portion of the tamper-indicating device is operatively connected into circuitry of the tamper-signaling section so that when the tamper-signaling section is conductive, energizing current from the interrogating signal is able to cause the modulated response to the interrogating signal.

In a preferred form of the present invention the tamper-signaling section comprises operating components which are positioned within a housing of the tamper-signaling section. The operating components are responsive to the tamper-responsive section to produce the tamper-indicating signal. The tamper-responsive section comprises a plurality of tamper-responsive portions which are operatively connected to the tamper-signaling section in a manner that the signal transmitting section responds to any one of these tamper-responsive portions being in its intact or non-intact condition.

In a specific application of the present invention, a first connecting portion of the tamper-indicating device is connected to one of the two components, and a second connecting portion of the tamper-indicating device is connected to the other of the two components, with a tamper-responsive region of the tamper-responsive section being between the connecting portions in a manner that relative movement of the two components causes the tamper-responsive region to become severed or damaged to make the electrically conductive portion become non-conductive.

In some arrangements the two components have facing surfaces adjacent to one another, and the tamper-indicating device is positioned between the two facing surfaces. The first connecting portion of the tamper-indicating device is connected to one of the two components and the second connecting portion is connected to the other of the components in a manner that relative movement of the two components moves the two facing surfaces apart to cause a break or damage to the electrically conductive portion.

In other arrangements, there is a plurality of these tamper-indicating devices positioned between the two facing surfaces and connected to the facing surfaces, and the tamper-indicating devices are arranged so as to be positioned inwardly from surrounding edge portions of the surfaces so that relative rotational movement of the components to rotate the facing surfaces away from one another causes at least one of the tamper-indicating devices to go to its non-intact position. In another arrangement the first and second connecting portions of the tamper-indicating device are located on the tamper-responsive section, and the tamper-responsive section is connected to surface of the two components which are in general alignment with one another and spaced from one another.

Some aspects of the invention provide a method of remotely monitoring the status of multiple fire extinguishers, the method comprising coupling sensors to respective fire extinguishers in sensing relation to the fire extinguishers, the sensors each being configured to sense a parameter of the fire extinguisher to which it is coupled; associating transmitters with respective fire extinguishers, the transmitters being configured to selectively transmit information identifying the fire extinguisher with which the transmitter is associated and to selectively transmit information indicative of the sensed parameter; providing a receiver in selective wireless communications with the transmitters; and providing a computer coupled to the receiver, the computer being configured to maintain testing schedules for respective fire extinguishers and being configured to provide an output when it is time for an extinguisher to be inspected, tested, or undergo maintenance, the computer also being configured to selectively store information from a plurality of the transmitters.

Other aspects of the invention provide a system for remotely monitoring the status of one or more fire extinguishers includes means for sensing at least one parameter of each of the fire extinguishers; means for selectively transmitting the sensed parameters along with information identifying the fire extinguishers from which the parameters were sensed; and means for receiving the sensed parameters and identifying information for the fire extinguisher or extinguishers at a common location. The sensed parameters may be, for example, removal of a trigger pin or movement of a fire extinguisher. Other systems and methods for remotely monitoring the status of one or more fire extinguishers are also provided.

BRIEF DESCRIPTION OF THE DRAWINGS

Preferred embodiments of the invention are described below with reference to the following accompanying drawings.

FIG. 2 is a semi-schematic plan view of a portion of a false ceiling where there are ceiling tiles supported by a plurality of support members, with the tamper-indicating device of a first embodiment of the present invention shown in its installed position.

FIG. 3 is a plan view, as in FIG. 2, showing somewhat schematically one of the tamper-indicating devices of the present invention, having two tendrils.

FIG. 4 is a view similar to FIG. 3, showing a tamper-indicating device having four tendrils and being positioned at the juncture of corner portions of four adjacent ceiling tiles.

FIG. 10 is a plan view showing three of the tamper-indicating devices of FIG. 9 positioned at the bottom surface of a security-sensitive object.

FIG. 11 is a side elevational view of the arrangement of FIG. 10, showing the three tamper-indicating devices positioned between the security-sensitive object and a support member, such as a table top.

FIG. 12 is a side elevational, partly in section, showing yet a seventh embodiment of the present invention.

DETAILED DESCRIPTION OF THE PREFERRED EMBODIMENTS

Figure 1:
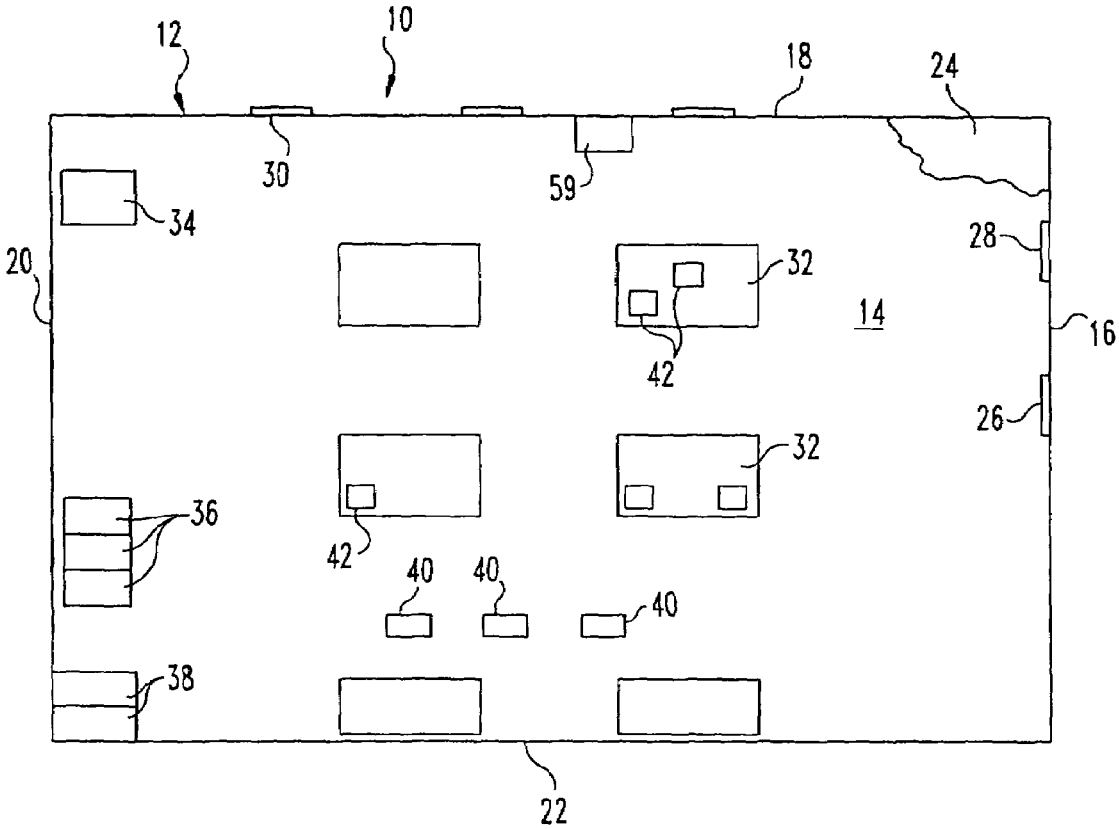
FIG. 1 is a schematic plan view of a building facility in which the system, apparatus and method of the present invention can be incorporated.

In FIG. 1, there is illustrated by way of example, an environment in which the system of the present invention could be used advantageously. FIG. 1 shows schematically a building facility which comprises a building structure 12 defining a secured area 13. The structure 12 comprises a floor 14, four sidewalls 16, 18, 20 and 22, and a ceiling (a portion of which is indicated at 24). The sidewall 16 has a doorway (exit/entrance) 26 for ingress and egress to and from the security-sensitive area 13 and an emergency exit doorway 28. The wall 18 has three windows 30 leading to an outside location.

Within the secured area 13, are a number of desks 32 which would normally be used by the personnel in the secured area 13 during working hours. By way of example, there is a locked safe 34 (or vault), three locked file cabinets 36 and two unlocked file cabinets 38, which are positioned adjacent against the wall 20. There is also shown somewhat schematically several security-sensitive items generally designated 40, and these would be various movable items which would quite commonly be in a security-sensitive area. These could include documents, written communications, computer hard drives, discs, and other computer information media, funds and currency, items which contain evidence or evidentiary data, high valued items, etc. However, in the non-working periods during which the security-sensitive area may not have any people therein, these security-sensitive items 40 will be placed either in the safe 34, one of the locked file cabinets 36 or some other secure location.

At this point it would be helpful for a more complete understanding of the present invention to indicate that the present invention can be combined with or incorporated with one or more other security systems. One such security system is described in U.S. patent application Ser. No. 10/042,742, entitled "Radio Frequency Personnel Alerting Security System and Method", filed Sep. 23, 2002, which is incorporated by reference herein. This other security system is particularly adapted for maintaining the security of the moveable security-sensitive items 40, as indicated above. Later in the present text this other security system will be summarized and it will be indicated how the two systems could be used in combination. Thus, the contents of this other above mentioned patent application are incorporated herein by reference.

To continue now with the description of the present invention, reference is again made to FIG. 1. There are the other objects or components indicated at 42, which are also security-sensitive either because of the information they contain or possibly for some other reason, such as being a rather expensive item which should be protected from theft. These could be, for example, computer related equipment, or a locked container which is used to contain security-sensitive documents and which for convenience is placed on a person's desk. These objects 42 are characterized in that either for reasons of size, or convenience, it is not practical (or desirable) to place these in a secured location, such as a safe 34 or the locked file cabinet 36.

Also, these objects 42 could be such things as the safe 34 and 25 the locked file cabinet 36. Even though these are securely locked, they could be susceptible to security risks by someone simply removing the entire safe 34 or locked file cabinet 36 from the security-sensitive premises. Then these could be opened at some other location to remove the security-sensitive documents. Also, there are other security problems, such as unauthorized personnel making a covert entry through the building structure into the secured area. Aspects of the present invention relate to maintaining security for these sorts of items and situations.

With the above being given as further background information, there will now be described the various embodiments of the present invention.

A first embodiment of the present invention will now be described with reference to FIGS. 1–5. As indicated previously in the introductory portion of this text under the subject heading "Background Art", there is one type of security problem where there is a security-sensitive area where the surrounding walls are not true floor to true ceiling walls, but extend only partially toward the true ceiling. Then there is a false ceiling made up of ceiling tiles which are supported by metal support members (beams) that extend in a grid-like pattern over the ceiling area at a location spaced downwardly from the true ceiling. Also (as indicated earlier in this text), in the prior art where that area with the false ceiling tiles is security-sensitive, in many instances the use of ceiling tile clips is required to be installed in the ceiling system. Then when any of these ceiling tile clips are disturbed (for example by a person moving or removing one of the ceiling tiles), visual inspection will indicate that this disturbance has occurred, thus indicating the possible occurrence of a covert intrusion. Both the initial installation of the ceiling tile clips and the regular visual inspection are costly. Also, if a covert intrusion has occurred, it may be many hours later that the visual inspection is made. This first embodiment is designed to alleviate this problem.

To describe now this first embodiment reference is first made to FIG. 2 which shows a portion of the aforementioned false ceiling 24, and specifically there is shown in FIG. 2 four of the individual ceiling tiles 46 supported by the support members formed in a rectangular grid pattern, these support members being indicated schematically at 48. Depending upon the size of the area of the false ceiling 24, there could be as many as several hundred tiles 46. These are arranged in a rectangular grid pattern, and the four tiles 46 that are shown in FIG. 2 are arranged in such a configuration, so that there is a juncture location 50 at which four adjacent corners 52 of the tiles 46 meet are closely adjacent to one another.

In accordance with the present invention, there is located at each of these juncture locations 50 a tamper-indicating device 54. This device 54 incorporates basic RFID technology, and in this particular embodiment comprises an operating or transmitting section 55 which comprises a containing housing 56, and a tamper-indicating section 57 which in this particular arrangement shown in FIG. 2 (and also shown in FIG. 4) comprises four elongate fingers or tendrils 58 which are operatively connected to the transmitting section 55. As shown herein, these four tendrils extend outwardly from the housing 56, with these tendrils 58 being oriented at right angles to one another. As can be seen in FIG. 2, each of these tendrils 58 reaches outwardly to extend over the corner portion 52 of a related ceiling tile 46. Each tendril 58 is bonded or otherwise secured to its related ceiling tile 46. If one of these ceiling tiles 46 is moved, as will be described later herein, the tendril 58 (which is attached to that tile 46) would break or otherwise be damaged so as to cause a separation or break of a frangible wire of the tendril 58.

When one of the tendrils 58 is so damaged, this causes the tamper-indicating device 54 to transmit an electromagnetic alarm signal (desirably an RFID signal which would identify that particular tamper-indicating device) to a suitable receiver/monitor indicated schematically at 59, which in turn provides a signal to cause remedial action to be taken (see FIG. 1). Such action quite likely would be an on site investigation at the location of signal producing RF tamper-indicating device or devices 54 to see if a covert intrusion has been made into the secured area.

In FIG. 4, there is shown an RF tamper-indicating device 54 which has four such tendrils 58, and in FIG. 3, there is shown another RF tamper-indicating device 60 having an operating section 61 with two tendrils 62 extending oppositely from one another. It can be seen in FIG. 2 that this RF tamper-indicating device 60 is used at a location where there are only two adjacent ceiling tiles 46.

The tamper-indicating device 54 and 60 can be considered as a specialized form of an RFID tag. Accordingly, in the following text, for convenience, the tamper-indicating device will often be referred to as a "tag", "RF tag", or "RFID tag".

While the first embodiment of the present invention has been described only with reference to the ceiling tiles 46, it is to be understood that it could be applied to other components of the building structure 12. For example, the windows 30 may be of a nature that these are seldom opened (or opened not at all), and yet these would present possible opportunities for a covert entry. The radio frequency tamper-indicating device 54 or 60 could be used with these in generally the same manner as indicated above. Also, there may be structural panels or components which are joined together to form, for example, the walls or ceiling portions of some other design, and the radio frequency tags or members 54 and/or 60 could be used to provide security at those locations also.

Figure 5A:
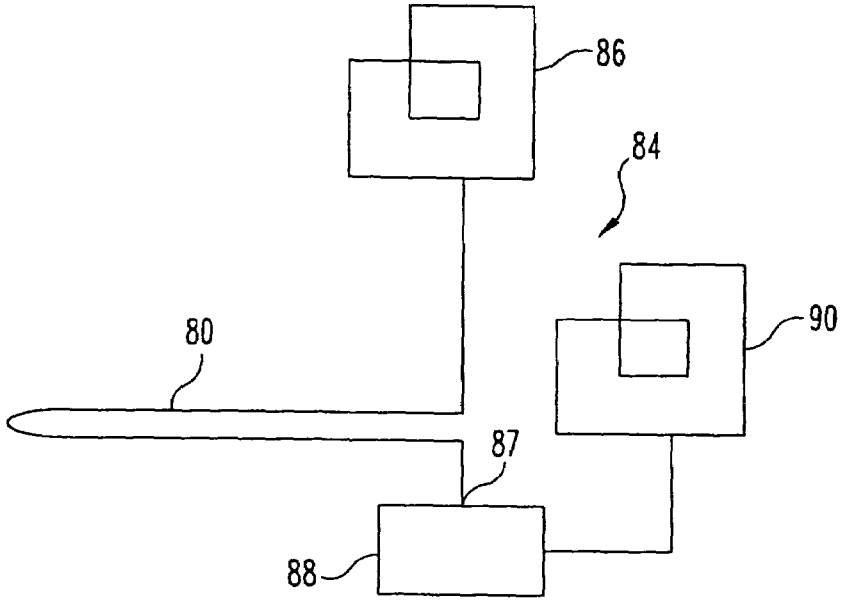
FIGS. 5A and 5B are each a schematic drawing of a passive tamper-indicating device similar to that shown in FIG. 5.
Figure 5B:
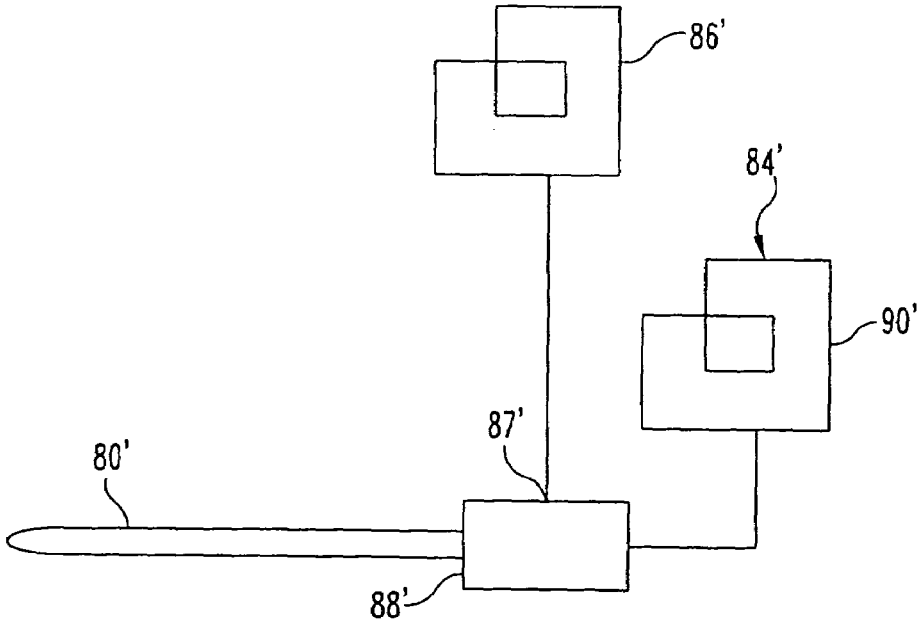
Figure 5:
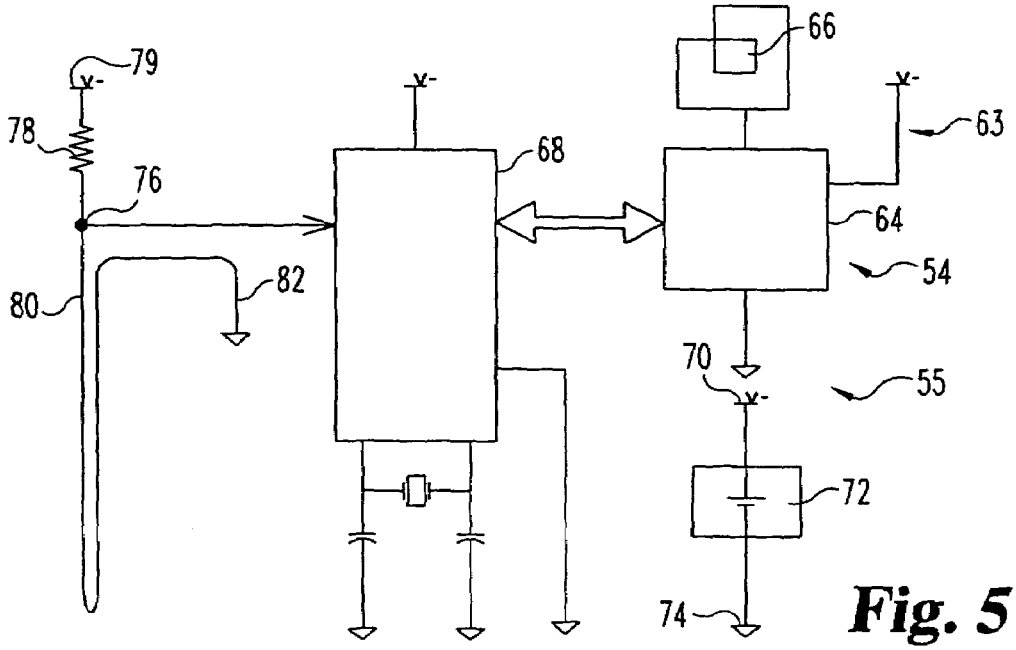
FIG. 5 is a schematic view showing the main components and circuitry of a first embodiment of the present invention.

To describe the components of the operating section 55 of the RF tag 54 or 60, reference is made to FIG. 5. In the text which follows, since the operating components of the tags 54 and 60 are identical (or substantially identical), reference will be made only to the tag 54 with the understanding that the description refers as well to the tag 60. These operating components are collectively designated as a signal generating apparatus, which is identified by the numeral 63. This apparatus 63 comprises a transceiver 64 that is operatively connected to an antenna 66. The transceiver 64 has the capability to transmit through the antenna 66 an electromagnetic signal to the receiver monitor 59 (see FIG. 1).

The transceiver 64 is also operatively connected to a micro-controller 68 (e.g., a microprocessor), such as the Texas Instruments MSP430 series or any other suitable processor, and has an operative connection at 70 to a battery 72 which in turn is connected to ground at 74. Any conventional transceiver 64 can be used as long as it is compatible with the micro-controller 68 and can be activated by a signal from the micro-controller 68. The micro-controller 68 is normally in a very low power "sleep mode" until activated. To activate the micro-controller 68 there is provided a connection at 76 to a resistor 78 that is in turn connected to a positive voltage terminal 79 from the battery 72. The connection at 76 also connects to the aforementioned frangible wire of the tendril 58. This frangible wire is indicated herein at 80 and (as indicated previously) is part of its related tendril 58. The other end of the frangible wire connects to a ground at 82. In this particular embodiment, the frangible wire 80 extends in an elongate loop, and the connections at 76 and 82 are adjacent to the RF tag housing 56. The resistance level of the wire 80 is relatively low and the resistance level of the resistor 78 is relatively high. Accordingly, in the sleep mode very little current flows through the resistor 78, and the voltage at the connection 76 is essentially at ground.

To describe now the operation of the RF tag 54, as indicated above, the micro-controller (micro-controller) 68 is normally in the low power sleep mode. When a security breach breaks the frangible wire 80 in the tendril 58, this causes the connection at 76 to swing from a low voltage state to the voltage at the terminal 79 through the resister 78. This state causes an edge triggered interrupt within the micro-controller (micro-controller) 68, and the micro-controller in turn powers up from its sleep state and activates the transceiver 64 (functioning as a transmitter). The transceiver 64 then sends a signal through the antenna 66 to the receiver/monitor 59. This signal which is sent to the receiver/monitor 59 gives a message indicating that "I am damaged; my wire 80 has been broken or disconnected".

This particular type of RFID tag (tamper-indicating device) 54 described in reference to FIG. 5 is constructed so that in the sleep mode almost no charge is required to maintain the alert condition of the device 54, and the device 54 could be operational in its sleep mode, for as long as possibly two years or more. At that time, another battery could be installed, or assuming the cost of the RF tag 54 is sufficiently low cost, a new tag 54 could be installed.

Alternatively, this system could be arranged so that the tamper-indicating devices 54 and 60 would be made as passive RFID tags where the tag 54 or 60 would not have a power source as a battery 72, and the power of an interrogation signal would be sufficient to generate the response as needed from the tag 54 or 60. In this instance the tags 54 and 60 would likely be arranged so that when interrogated, when the tag 54 or 60 is intact (i.e., the wire 80 is not broken), the tag 54 or 60 would give an "I'm okay" response. On the other hand, when the tag 54 or 60 is interrogated and no response is received, then this lack of a response would be interpreted as indicating that the tag 54 and 60 is inoperative (which would usually mean that the wire 80 is broken or damaged.

The tamper detecting device 84 by which this could be accomplished is shown schematically in FIG. 5A. There is a receiving antenna 86, operatively connected to one end of the wire loop 80, with the other end of the loop 80 being connected to an input 87 of the operating circuitry 88 which would include the micro-controller and other related components. The output of the operating section 88 connects to a transmitting antenna 90 from which the modulated return signal is directed back to the interrogating/receiving location or simply back to one or more receiving locations. The operating section 88 would be activated by the energy that the receiving antenna 86 absorbs from the interrogating signal and modulates this in a manner that the modulated signal would travel from the transmitting antenna 90 back to the receiving location.

In operation, when the wire 80 is intact, the interrogating signals would generate a modulated response that would be received as an "I'm okay" signal. Since the modulated response identifies that particular tag 54, this response will be interpreted as coming from a particular tag location. On the other hand, when the wire 80 is broken, the power from the interrogating signal is not transmitted from the receiving antenna and no response is generated from the operating section 88. Thus, the transceiver/monitoring apparatus would recognize that no response was given to that interrogated signal and this would indicate that the wire 80 at this particular tag was broken, and thus indicating a possible security risk occurrence.

A modified version of the device is shown in FIG. 5B. The components of the device shown in FIG. 5B which are the same as or similar to components of the tamper-indicating device 84, FIG. 5A, will be given light numerical designation with a (') designation distinguishing those of this modified version of FIG. 5B. The tamper-indicating device 84' of FIG. 5B and comprises the same antennas 86' and 90', the circuitry 88', and the wire loop 80'. However, the wire loop 80' is not connected in series between the antenna 86' and the circuitry 88'. Rather, the wire loop is connected to the circuitry 88' and its intact and non-intact configurations are detected in the manner described previously herein relative to the embodiment shown in FIG. 5. Also, the receiving antenna 86' has a direct connection at 87' to the circuitry 88'. The return signal from the circuitry 88' is, as in the circuitry of FIG. 5A, transmitted to the transmitting antenna 90'.

Within the broader scope of the present invention, there could be a number of variations. Three of these are shown as additional embodiments in FIGS. 6A, 6B and 6C.

Initially the second embodiment shown in FIG. 6A will be described. In describing this second embodiment, components of the second embodiment which are essentially the same as (or similar to) components of the first embodiment will be given like numerical designations, with a "a" suffix distinguishing those of the second embodiment. The tag in the embodiment of FIG. 6A is the same as shown in FIG. 5, in that there is the transceiver 64, the antenna 66, the micro-controller 68, and the battery 72, as shown in FIG. 5 (not shown in FIG. 6A).

Accordingly, only those components of the second embodiment shown which function somewhat differently or are in a somewhat different arrangement are illustrated in 6A.

Figure 6A:
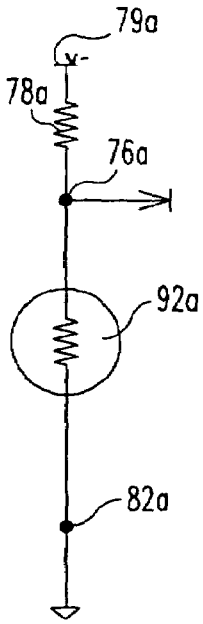
FIGS. 6A, 6B and 6C are schematic views of second, third and fourth embodiments having other arrangements of a tamper-indicating device which would be useable in broader applications of the present invention.

In FIG. 6A, there is the connection 76*a* to the micro-controller (68 in FIG. 5), and there is also the voltage source 79*a* which connects to the connection 76*a* through the high resistance resistor 78*a*. However, instead of having the frangible wire 80, there is provided a thermistor 92*a* connected to the connection 76*a* and to the ground connection 82*a*. This thermistor 92*a* normally is conductive, but if the ambient temperature rises above a predetermined level, the electrical resistance increases. Accordingly, this will initiate a signal to the micro-controller 68 which will in turn transmit an alarm signal that there is a high temperature condition at the thermistor 92*a*, this high temperature condition possibly resulting from a fire.

Figure 6B:
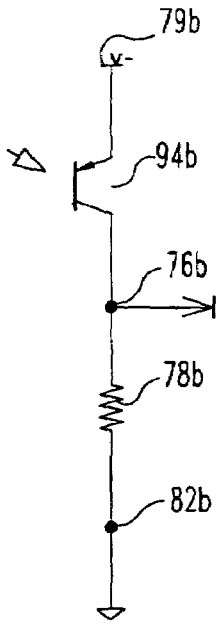

In FIG. 6B, there is shown a third embodiment, and as in the description relative to the embodiment of FIG. 6A, the components of this third embodiment which correspond to components in the first and/or second embodiments will be given like numerical designations, but with a "b" suffix distinguishing those of the third embodiment.

This RF tag of the third embodiment is somewhat similar to the second embodiment of FIG. 6A, but it differs in that the resistor 78*b* is connected between the connecting points 76*b* and 82*b*. Then there is located between the voltage source 79*b* and the connection 76*b* a phototransistor 94*b*. The phototransistor 94*b* is normally nonconductive, but when a light is shone upon the phototransistor 94*b*, it then becomes conductive. Accordingly, it can be seen that in normal operation (when there is no light directed to the phototransistor 94*b*) the contact 76*b* will be at ground potential. Then when the phototransistor 94*b* becomes conductive, thus forming a conductive path from the points 79*b* to 76*b*, this activates the micro-controller to cause the alarm signal to be generated. For example, this RF tag could be located in a dark room, and if an anomalous light source is detected, this would create an alarm signal.

This third embodiment could be used in a variety of situations, and these are discussed further later in this text. However, to give one example at this time, the light sensitive surface of the photoresister could normally be covered by an opaque cover in an environment where there is light. The security intrusion or movement of security-sensitive item would result in the opaque cover being removed from the light sensitive surface, thus triggering an alarm.

Figure 6C:
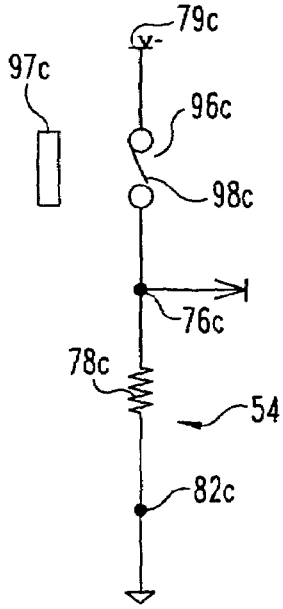

FIG. 6C shows a fourth embodiment, and components of this fourth embodiment which are similar to prior embodiments will be given like numerical designations with a "c" suffix distinguishing those in the fourth embodiment. This RF tag 54 of the fourth embodiment is substantially the same as the third embodiment of FIG. 6B, except that in place of the photo transistor 94*b*, there is provided a magnetic reed switch 96*c* which is normally open. Then when the switch 96*c* comes in proximity to a source 97*c* of a magnetic field, then the switch element 98*c* closes. An application of this embodiment (in a somewhat modified form) will be described later herein.

Figure 7:
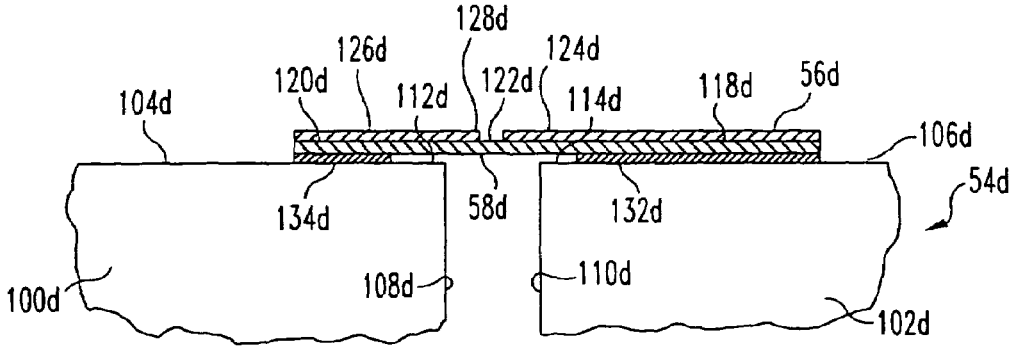
FIG. 7 is a side elevational view, partly in section, showing a fifth embodiment of the tamper-indicating device.
Figure 8:
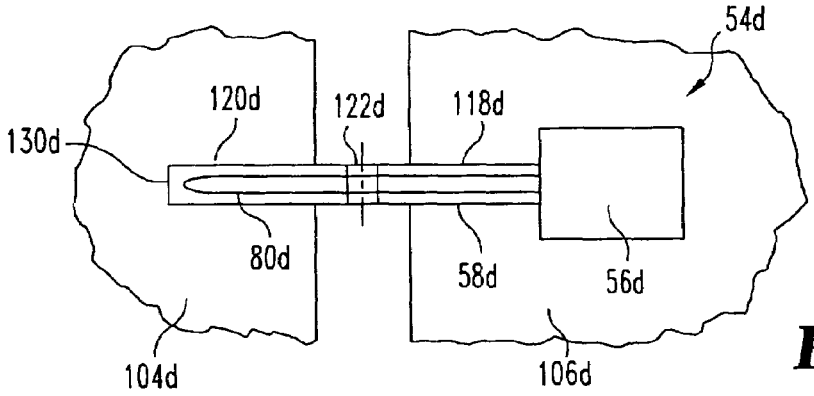
FIG. 8 is a plan view of the tamper-indicating device of FIG. 7.

Reference is now made to FIGS. 7 and 8 which show a fifth embodiment. In describing this fifth embodiment of FIGS. 7 and 8, components which are similar to corresponding components in one or more of the prior embodiments will be given a like numerical designation or designations, with a "d" suffix distinguishing those of the fifth embodiment.

FIG. 7 is a side elevational view where there are shown two objects 100*d* and 102*d*, with these having first parallel and aligned surfaces 104*d* and 106*d*, respectively, aligned in a common plane, and two other parallel surfaces 108*d* and 110*d* which face one another and are spaced laterally from one another, with the surfaces 104*d* and 108*d* being at right angles to one another and meeting at a corner edge 112*d*, and the surfaces 106*d* and 110*d* also being at right angles to one another and meeting at an edge location 114*d*. These two objects 100*d* and 102*d* could be two building structural components which are adjacent to one another, or the object 100*d* could be stationary structure, and the object 102*d* could be a security-sensitive container or some other security-sensitive object which is moveable and adjacent to the stationary structure 100*d*. Or these two members or components 100*d* and 102*d* could be two moveable objects which in a normal configuration would be adjacent to, or at least contiguous to, one another, but or of such a nature that when one of these is moved relative to the other, this would indicate an occurrence that may relate to a security risk.

With further reference to FIGS. 7 and 8, the radio frequency tag or member 54*d* comprises a housing 56*d* containing the operating components and one arm or extension member 58*d* which is comparable to the tendril extension member 58. The housing 56*d* has at its bottom surface an adhesive coating 116*d*, by which the housing 56*d* can be securely bonded to the surface 106*d*. The tendril or arm 58*d* has two portions, namely a first portion 118*d* which is directly connected into the housing 56*d*, and a second portion 120*d* which is at the outward end of the tendril 58*d* (i.e., further from the housing 56*d*). The two tendril portions 118*d* and 120*d* are joined to one another along a serrated or otherwise weakened juncture line or location 122*d* so that the two sections 118*d* and 120*d* can be more easily separated from one another at the location 122*d*.

There are provided a pair of stiffening plates, 124*d* and 126*d*. The stiffening plate 124*d* is fixedly connected (e.g., by bonding) to the tendril portion 118*d*, and the other stiffening plate 126*d* is fixedly attached (e.g., bonded) to the tendril portion 120*d*. These two plates 124*d* and 126*d* have adjacent edges 128*d* which are positioned closely to one another on opposite sides of the serrated or weakened location 122*d*.

In the plan view of FIG. 8, it can be seen that the tendril 58*d* comprises the wire loop 80*d* embedded into a rather thin elongate strip of material 130*d*. This could be plastic material or a plastic/fabric material could be similar to a piece of adhesive tape. The lower surface of the two tendril portions 124*d* and 126*d* each have an adhesive layer 132*d* and 134*d*, respectively, by which the tendril portions 126*d* and 124*d* are bonded to their respective upper surfaces 106*d* and 104*d*.

To describe the operation of this fifth embodiment of FIGS. 7 and 8, it should first be noted that the two rigid plates 124*d* and 126*d* are each bonded to their respective tendril portions 118*d* and 120*d* that are in turn bonded to the surfaces 106*d* and 104*d* of the objects 102*d* and 100*d* so that two rigid plates 124*d* and 126*d* and the tendril portions 118*d* and 120*d* are fixedly connected to their respective objects 100*d* and 102*d*. Thus, when there is even a slight relative movement between the two objects 100*d* and 102*d*, there will be a break occurring along the serrated location 122*d* of the tendril 58*d*.

Figure 9:
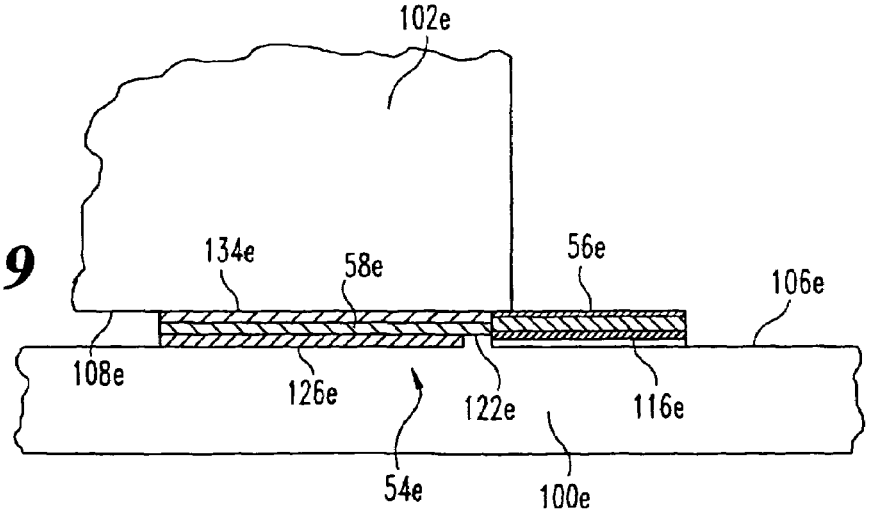
FIG. 9 is a side elevational view, partly in section, similar to FIG. 7, showing a sixth embodiment of the present invention.

To describe now the sixth embodiment of the present invention, shown in FIG. 9. As with the prior embodiments, components which are similar to the components of the prior embodiments will be given like numerical designations, with an "e" suffix distinguishing those of this sixth embodiment.

In FIG. 9 the RF tag or member 54*e* is positioned between two objects 100*e* and 102*e*, having facing flat surfaces 106*e* and 108*e*—which are closely adjacent to one another, with only the thickness of the RF tag 54*e* separating the two surfaces 106*e* and 108*e*. The object 100*e* could be, for example, a table top or a counter top, and the object 102*e*, could be, for example, a security-sensitive item such as a piece of computer equipment, or possibly a locked container which itself contains security-sensitive items.

This RF tag 54*d* has a housing 56*e* and a single tendril 58*e*. The overall configuration of this tag 56*e* can be the same as, or substantially the same as the tag 54*d* of the fifth embodiment.

The housing 56*e* is for the most part located adjacent to, but spaced laterally from, the object 102*e* so that its antenna is not shielded by the object 102*e*. The housing 56*e* has on its lower surface an adhesive layer 116*e* so as to be bonded to the surface 106*e*, and the upper surface of the tendril 58*e* has an upper adhesive surface 134*e* so as to be bonded to the surface 108*e*. In addition, the tendril 58*e* has bonded to its lower surface a rigid plate member 126*e*. There is a serrated or weakened portion 122*e* in the tendril 58*e* at a location closely adjacent to the housing 56*e*.

To describe the operation of this sixth embodiment, reference is now made to FIGS. 10 and 11. Let us assume (as suggested earlier) that the lower member 100*e* is a table top and the object 102*e* is a piece of computer equipment which is security-sensitive. Further, it is expected that the piece of computer equipment 102*e* is to remain at a stationary location on the table top 100*e* for an extended length of time. To accomplish this, a plurality of the RF tags 54*e* are placed at spaced locations along the bottom surface 108*e* of the object (e.g., computer equipment) 102*e*, so that the top adhesive layer 134 sticks to the lower surface 108*e* of the computer equipment 102*e*. Then the piece of computer equipment 102*e* is placed on the top surface 106*e* of the table top 100*e* so that the bottom adhesive surfaces 116*e* of each of the housing portions 56*e* of the three RF tags 54*e* adheres to the upper surface 106*e* of the table top 100*e*. The adhesive layer 116*e* and 134*e* could initially be covered by a removable protective layer.

Now let us assume that someone wishes to remove this piece of computer equipment 102*e* from its position on top of the table 100*e*. Obviously, if the person simply lifts the computer equipment 102*e* from the table, each of the housing sections 56*e* of the three tags 54*e* will adhere to the upper surface 106*e* of the table top 100*e*, and the tendril sections 58*e* of each of the tags 54*e* will adhere to the piece of computer equipment 102*e*. This will cause the wire loop 80 and each of the tendrils 58*e* to break, with the RF tags 54*e* giving the alarm signal.

Now let us take the situation where the thief is aware of the use of the RF tags, and the thief attempts to somehow sever the adhesive layers 116 that adhere to the surface 106*e* or possibly the adhesive layers of the tendril portions 58*e* that adhere to the bottom surface of the computer equipment 102*e*. Let us further assume that this person is successful of slipping a very thin severing tool underneath the computer equipment 102*e*. It is likely that this attempt to sever, for example, the RF tag 54*e* on the right side of FIG. 11 will raise the right side of the computer equipment 102*e* at least a short distance. This would cause the computer equipment 102*e* to rotate at least slightly about the left RF tag 54*e* so as to tend to raise at least one of the other RF tags 54*e* slightly above the surface 106*e*. The effect of this would be to separate the housing 56*e* from the tendril portion 58*e* along the severance line 122*e*, thus causing the alarm signal to be given.

A seventh embodiment of the present invention is shown in FIG. 12. As in the description of the other embodiments, components of earlier embodiment will be given like numerical designation with the "f" distinguishing those of this seventh embodiment.

An examination of FIG. 12 will indicate that the RF tag 54*f* of this seventh embodiment is very similar to the fifth embodiment, except instead of having a single tendril section 58*e*, there are two oppositely extending tendril sections 58*f*.

Thus, there is the central housing section 56*f* and the two aforementioned tendril section 58*f* on opposite sides thereof. There is a top adhesive layer 134*f* over the top surface of each of the tendril sections 58*f*. Also, the lower surface of the housing 56*f* has an adhesive layer 116*f*.

Also, there are two rigid plates 124*f* and 126*f* bonded to the related tendril members 58*f* so that the lower surface of these two rigid plates 124*f* and 126*f* are in the same plane as the lower adhesive layer at 116*f* of the housing 156*f*.

The operation of this seventh embodiment of FIG. 12 is similar to the operation of the sixth embodiment of FIGS. 9–11. The particular application of this seventh embodiment could be used in other ways. For example, the two tendril sections 58*f* could be positioned beneath adjacent objects, so that either of the objects connected to their respective tendril sections 58*f* would activate the operating section contained in the housing 56*f*. Also, it may be that the object in which the tamper-indicating device 54 is attached has a somewhat different configuration where there are two side sections (e.g., where there is a U-shaped configuration in plan view). Then the housing section 56*f* could be placed in an open area between the two branches of the U, and the two tamper-indicating sections 58*f* could be under two side portions of the object to which the tamper-indicating device 54 is secured. In that instance, it could be that the tamper-indicating sections 58*f* could be spaced further from one another, or the center-located housing section 56*f* could be made at a greater length so as to extend further laterally.

Figure 13:
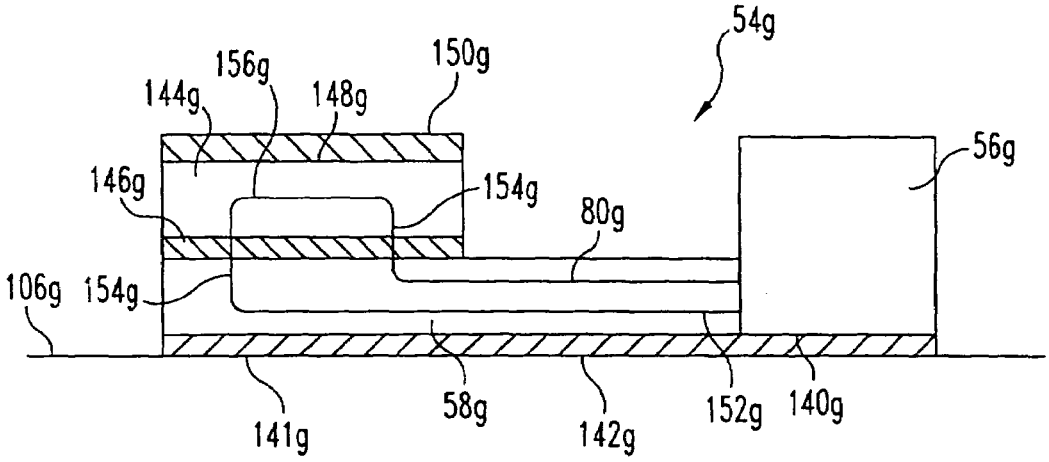
FIG. 13 is a view similar to FIG. 12, showing an eighth embodiment of the present invention.

An eighth embodiment is illustrated in FIG. 13. As in the description of prior embodiments, the components which are the same as, or similar to, components of any of the prior embodiments will be given like numerical designations, and in this instance, with a "g" suffix distinguishing those of this eighth embodiment. The depth of the RFID tag 54*g* is exaggerated for purposes of illustration.

The tag 54*g* comprises a housing 56*g* having a single tendril 58*g* extending outwardly therefrom. The bottom surface 140*g* of the housing 56*g* and the bottom surface 141*g* of the tendril 58*g* each have the same adhesive layer 142*g* that bonds both the housing 56*g* and the tendril 58*g* to the underlying surface 106*g*.

At the outer portion of the tendril 58*g* (i.e., further from the housing 56*g*) there is an additional tendril component 144*g* positioned immediately above an outer portion of the tendril member 58*g*, and this tendril component 144*g* has its lower surface bonded to the upper surface of the outer portion of the tendril 58*g* by a bonding layer 146*g*. The upper surface 148*g* of the upper tendril component 144*g* has a bonding layer 150*g*.

The wire member 80*g* has two first wire portions 152*g* which extend from the housing 56*g* through the main tendril member 58*g* and at the outer portion of the tendril member portions 152*g*, these two wire members 152*g* take an upturn at 154*g* to extend into the upper tendril component 144*g*. Then there is a connecting wire portion 156*g* which connects to the upper ends of the tendril portions 154*g*. Thus, these wire portions 152*g*, 154*g* and 156*g* form a continuous loop.

The lower bonding layer 142*g* and the upper bonding layer 148*g* make relatively strong bonds, while the intermediate bonding layer 146*g* makes a relatively weak bond.

Figure 14:
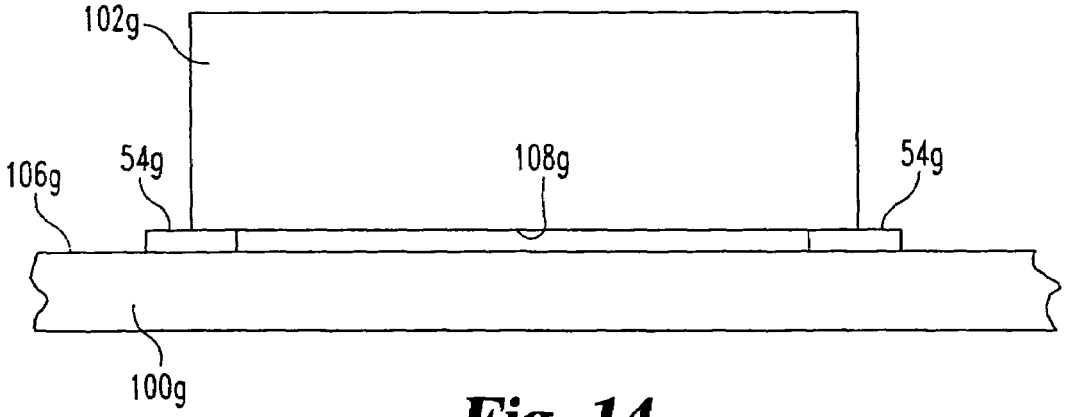
FIG. 14 is a side elevational view showing a couple of the tamper-indicating devices of FIG. 13 positioned under a security-sensitive item positioned on a support structure such as a tabletop.

To describe the operation of the eighth embodiment, reference is now made to FIG. 14, where it shows a pair of the RF tag members 54*g* positioned on a surface 106*g* of a table 100*g*, and there is shown an object, such as computer equipment 102*g* having a lower surface 108*g*. The lower surface 108*g* of the computer apparatus 102*g* is bonded to the upper bonding layer 148*g*, and the lower surface 140*g* of the housing 56*g* and the lower surface 141*g* of the tendril member 58*g* are bonded directly to the table surface 106*g* by the bonding layer 142*g*.

Let us now assume that someone is attempting to remove the computer apparatus 102*g* and also that this person recognizes that there may be some sort of security member between the apparatus 102*g* and the support member 100*g*. This person may simply wish to slide the computer member 102*g* over the table surface 106*g* in the hopes of foiling the action of the security member. However, with the arrangement of this eighth embodiment, the upper adhesive layer 148*g* will adhere strongly to the computer member 102*g*, while the lower bonding layer 142*g* will adhere strongly to the table top 106*g*. However, the relatively weak intermediate bonding layer 146*g* will give way and the upper tendril component 144*g* will slide laterally relative to the tendril member 58*g*. This will sever the two wire portions 154*g*.

Also, if it is attempted to raise one end of the computer apparatus 102*g* then again the upper tendril member 144*g* will separate from the lower tendril member 58*g*, also breaking the wire sections 154*g*. As in the previous embodiments, this will cause the operating components within the housing 56*g* to signal the alarm.

Figure 15:
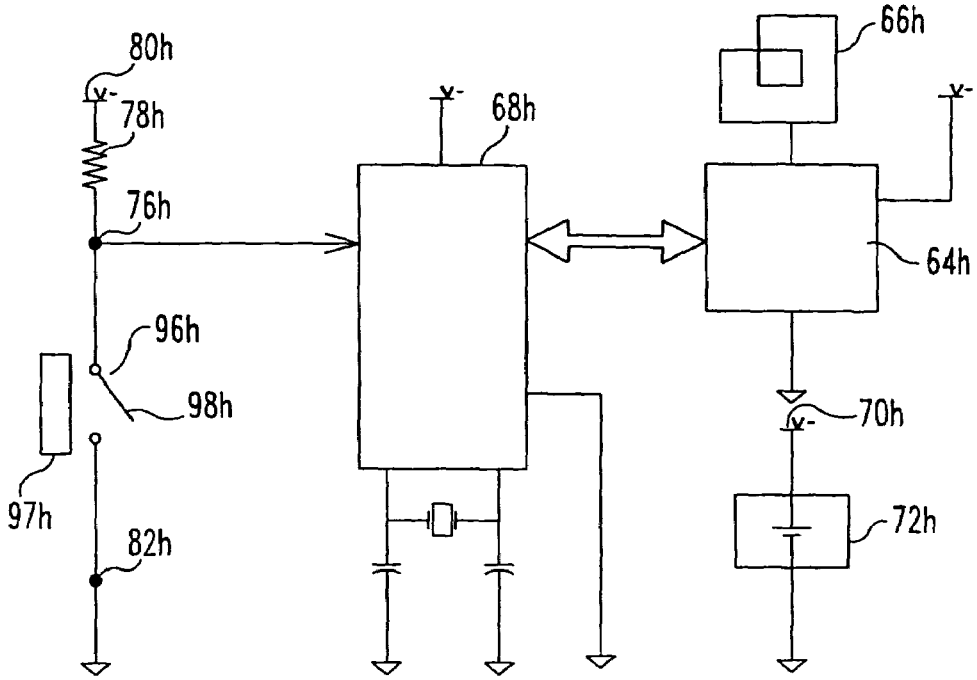
FIG. 15 is a schematic drawing of a tamper-indicating device of a ninth embodiment of the present invention.
Figure 16:
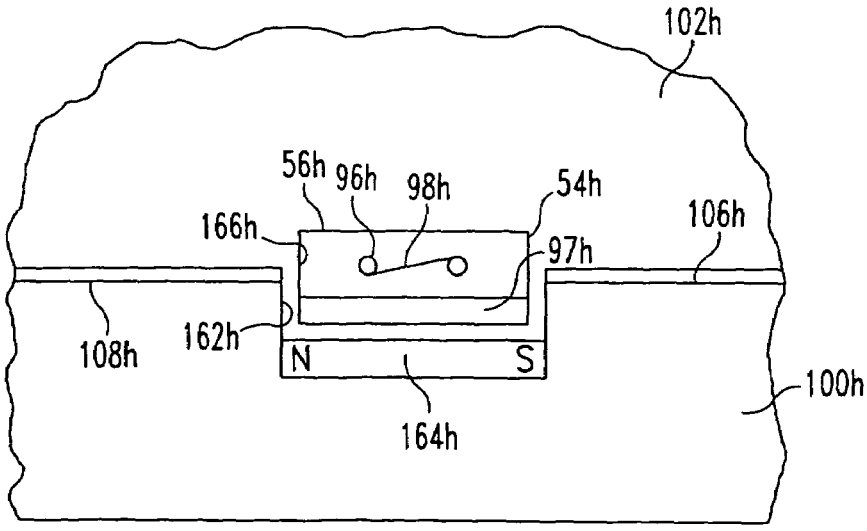
FIG. 16 is a side elevational view, partly in section, showing the tamper-indicating device of FIG. 15 in an operating position mounted into a security-sensitive object and positioned on a support structure such as a tabletop.

A ninth embodiment of the present invention is illustrated in FIGS. 15 and 16. As in the description of prior embodiments, the components of this ninth embodiment which are the same as, or similar to, components of the earlier embodiments will be given like numerical designations, but with an "h" designation distinguishing those of this ninth embodiment.

It is contemplated that within the broader scope of the present invention, the tamper-indicating section 57 of the first embodiment could utilize some component other than the wire 80, as shown in the 25 first embodiment and other embodiments. Such an arrangement is shown in this ninth embodiment.

In FIG. 15, substantially the same circuitry is shown as in FIG. 5, except that instead of having the wire 80 of the tendril, there is shown a magnetic reed switch 96*h*, such as shown in FIG. 6*c*. However, instead of having the magnet 97*c* of FIG. 6*c* as being itself a magnet, there is shown a magnetically permeable member 97*c* which is closely adjacent to the magnetic reed switch element 98*h*, with this magnetically permeable member 97*h* being part of the RF tag 54*h*.

To explain the operation of this ninth embodiment, reference will now be made to FIG. 16. In FIG. 16 there is shown a stationary support structure 100*h*, which could be, for example, a counter top or a floor of a structure. This structure 100*h* has formed in its upper surface a recess 162*h*, and there is positioned in the lower part of this recess 162*h* a permanent magnet 164*h*. The RF tag or member 54*h* is arranged so that the magnetically permeable member 97*h* is positioned at the lower part of the housing 56*h*, and the magnetic reed switch 96*h* is positioned immediately adjacent to the magnetically permeable member 97*h*. Further, the housing 56*h* is shown as fitting into a recess 162*h* formed at the lower surface 108*h* of the security-sensitive object 102*h* (which as in prior embodiments could be a container with security-sensitive documents, computer equipment, etc.).

With the object 102*h* (e.g., a security-sensitive container) being positioned on the surface 106*h* of the support structure 100*h*, the lower portion of the housing 56*h* of the RF member 54*h* extends downwardly a short distance into the recess 162*h*. In this location, the magnetically permeable member 97*h* is in contact with the magnetic member 164*h*. (As shown in FIG. 16, there is a small gap between the magnetically permeable member 90*h* and the permanent magnet 164*h*, and this is simply being done for purposes of illustration to indicate that these are separate members).

Thus, the magnetic flux of the permanent magnet 164*h* permeates the magnetically permeable member 90*h* to in turn cause it to simply function as an extension of the magnet 164*h* and thus bring the reed switch 98 to its closed position. The magnetically permeable member 97*h* is made up of a magnetically permeable material which does not have "magnetic memory". Accordingly, as soon as the object 102*h* is moved upwardly so as to also lift the RF tag 54*h*, the air gap that is formed between the member 97*h* and the magnet 164*h* is created, with the magnetic flux in the member 90*h* decreasing substantially so that it is not able to maintain the switch member 98*h* in its closed position. Thus, when the switch 97*h* moves to its open position, this immediately sends a signal to the micro-controller to in turn produce an alarm signal.

Also, it is to be recognized, as with at least some of the other embodiments, that it is possible to arrange the RF tag 54*h* so that it responds to an interrogating signal, in which case a modulated response is made by the RF tag 54*h* to provide an "I'm okay" signal to the interrogating apparatus. In that case, when the object 102*h* is in a secured position, with the switch element 98*h* with the switch 80*h* being in its closed position (as shown in FIG. 16), it will be interrogated periodically and give the "I'm okay" signal, and then will not respond when the object 102*h* is moved out of its secured position of FIG. 16. But when the modulated response is not received, this indicates a possible security risk occurrence.

Figure 17:
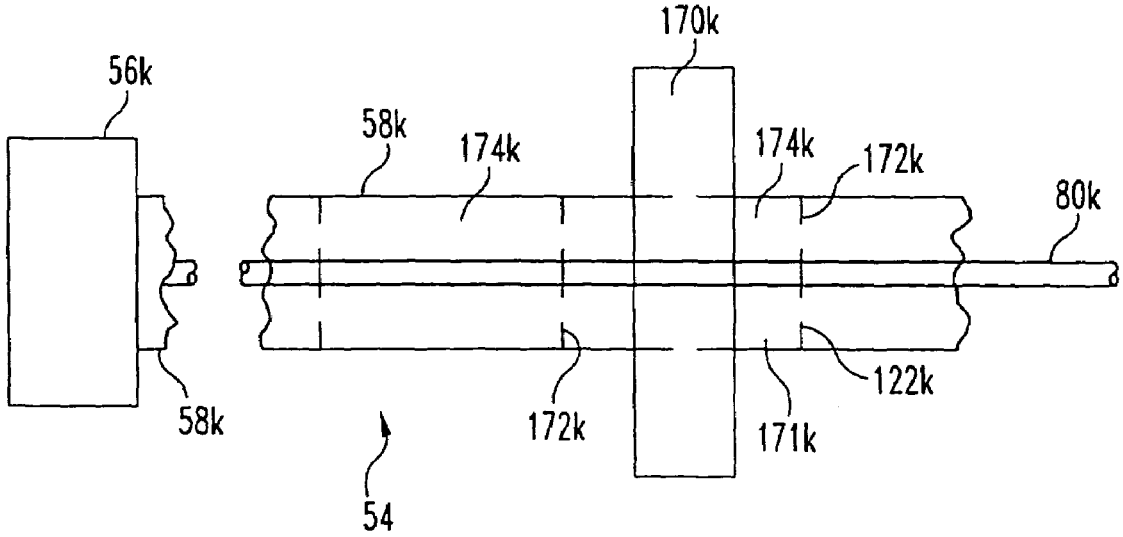
FIG. 17 is a top plan view showing a tenth embodiment of the present invention.
Figure 18:
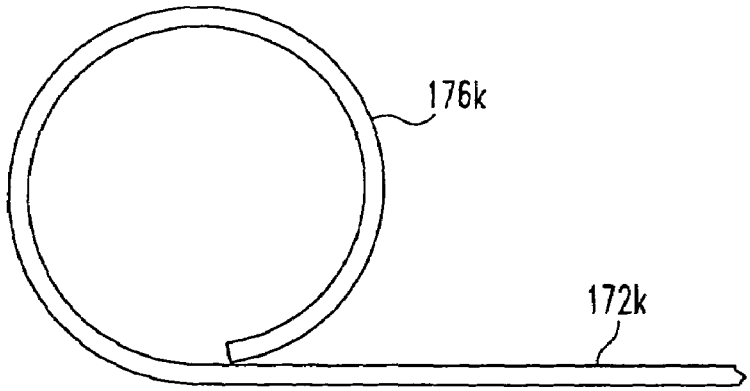
FIG. 18 is a view showing the portion of the tamper-indicating device of FIG. 17 with the elongated tamper-responsive section being in a rolled up configuration.

A tenth embodiment is shown with reference to FIGS. 17 and 18. As with the description of the prior embodiments, components of this tenth embodiment which are similar to components of prior embodiments will be given like numerical designations with a "k" suffix distinguishing those of this tenth embodiment. This tenth embodiment utilizes an RF tag 54*k*, which is the same as the RF tag 54 of the first embodiment, where the wire extends from the contact point 76 to a ground location. In this tenth embodiment, instead of utilizing the wire 80*k* in a relatively short tendril 58, the wire 80*k* extended outwardly for a more substantial length, such as ten feet, twenty feet, etc., up to the limit permitted by the design. Conceivably, the length of this wire could even be one hundred feet or several hundred feet. This wire 80*k* could be formed as two wires having the outer ends connected to form a—loop, or a single wire where the far end of the wire would simply be attached to a common ground with the RF tag 54*k*.

Part of the length of this wire 80*k* is shown, and there is illustrated schematically fasteners 170*k* at spaced locations also the wire 80*k*. These fasteners could be small adhesive strips. Also the wire 80*k* could be in or bonded to a plastic or fabric strip 171*k* with serrated "break" locations 172*k* at spaced intervals along its length where the wire 80*k* could be more easily broken.

It is apparent that if the break is made anywhere along the length of this wire 80*k*, this will cause the RF tag member 54*k* to send an alarm signal. One possible use for this tenth embodiment is, for example, where there is a location with various security-sensitive objects which would need to be made secure in a very short time. This strip 171*k* with the wire 80*k* and with its fasteners 170*k* could be wound up in a roll as shown at 176*k* in FIG. 17, and as the wire 80*k* with its attached strip 171*k* is unwound from the roll 176*k*, it could be wrapped over, across or around various objects, and also across openings of various sorts to create a more secured environment.

A possible modification of this tenth embodiment is that portions of this plastic strip are made with a bottom adhesive layer which is made with a rather high bonding strength in areas where there are the serrated break locations 122*k* arranged at spaced locations along the strip portion 172*k*. The bond strength of the adhesive layer is sufficiently strong so that if one section 174*k* between two break lines 122*k* is pulled up, the adjoining sections 174*k* would still adhere to the substrate, and the wire 80*k* would break at the break locations 122*k*. Thus, if an intruder is attempting to carefully remove the wire with the strip 172*k* carefully to avert detection, as soon as the person raises one of these sections 174*k* the break will occur and thus the alarm signal will be given.

At such time as they need for security in this particular location passes, then the information would be given to the control system that the alarm signal from the tag 54*k* would be disregarded so that the wire 80*k* with the many fasteners 170*k* and the strips 172*k* could all be removed from that temporarily secured area without triggering the alarm system.

It was indicated earlier in this text that the system of the present invention could advantageously be incorporated into one or more other security systems, and the one system in particular which was mentioned is described in the U.S. patent application entitled "Radio Frequency Personnel Alerting Security System and Method", naming the same inventors as in the present patent application.

Figure 19:
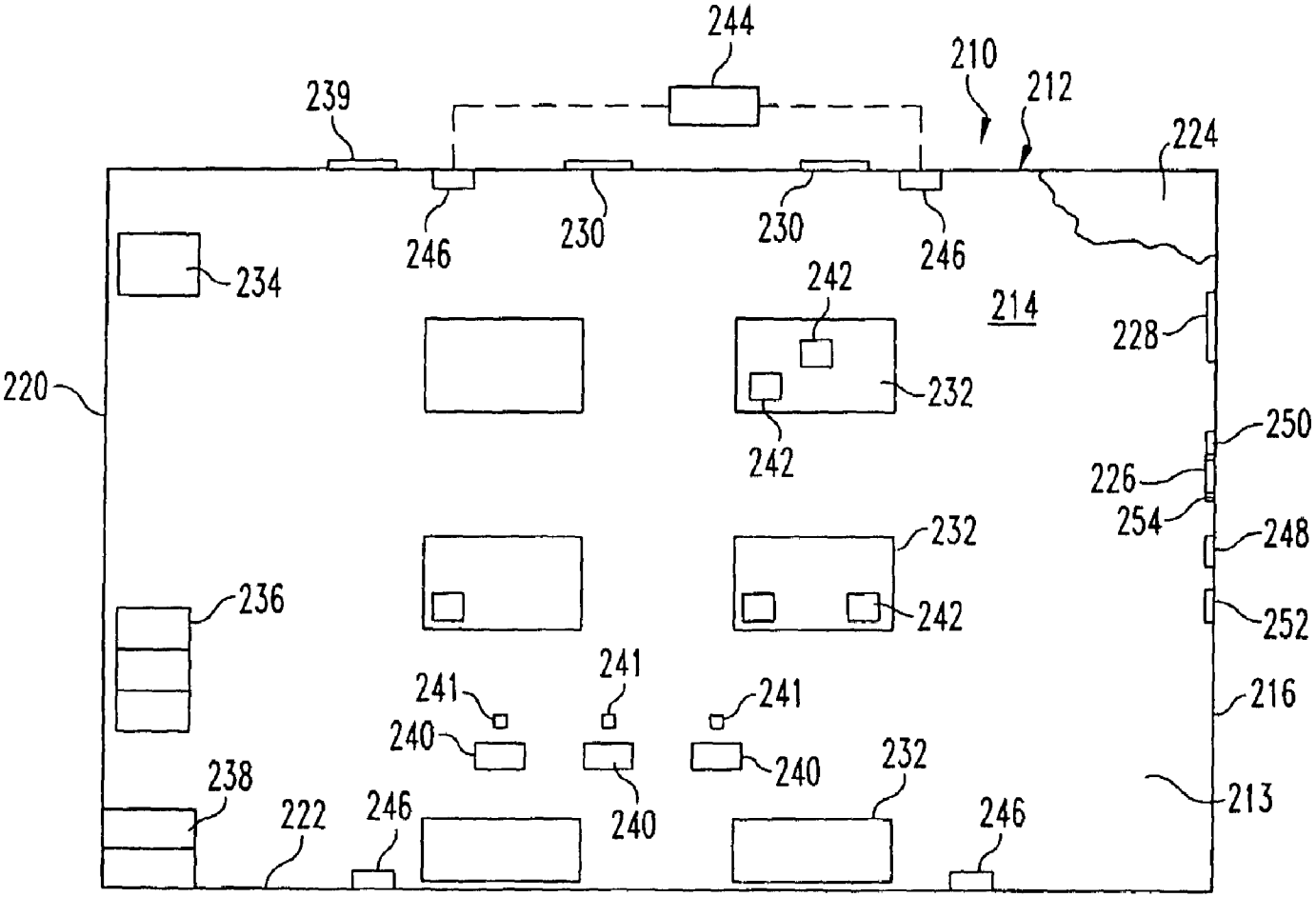
FIG. 19 is a plan view of a building facility, similar to FIG. 1, showing generally the same facility as shown in FIG. 1, but further showing components where the present invention is combined with a compatible security system.

The manner in which this is done will now be described with reference to FIGS. 19 and 20. It will readily be recognized that FIG. 19 shows substantially the same building facility as shown in FIG. 1, but with a few additions. The components shown in FIG. 19 which are the same as (or similar to) those shown in FIG. 1 will be given like numerical designations, but with the numeral "2" preceding the numerals that appear in FIG. 1. Thus, the building facility is designated 210 the building structure is designated 212, the desks are designated 232, the safe designated 234, etc.

With regard to the items which have been added to FIG. 19 and which do appear in FIG. 1 are several RFID tag members 241, each of which is shown being associated with a security-sensitive item 240. It will be recalled that earlier in this text it was indicated that these security-sensitive items 240 are items such as documents, computer discs, and other moveable items, which in their secured position are either locked in the vault 234 or locked in the file cabinets 236.

However, during working hours when authorized personnel are present in the secured area 213, the security-sensitive items 240 could be outside of the secured location and, for example, on a person's desk. There is also shown a monitoring and interrogation apparatus 244 which is operatively connected to one or more antennas. Four such antennas are shown at 246 and broken lines are shown at the top of FIG. 19 to indicate the operative connection of the two antennas 246 at the top of the page to the monitoring and interrogation apparatus 244. The two antennas 246 at the bottom of FIG. 19 have similar operative connections, but which are not shown for ease of illustration.

During non-working hours, during which the security-sensitive items 240 should be kept in a safe place, as indicated above, these items 240 could be kept either in the safe 234 or the locked file cabinets 236. Both the safe 234 and the locked file cabinets 236 are made of metal, and thus substantially block electromagnetic radiation or signals in the area.

To describe now the operation of the system of this additional security system, the monitoring and interrogation apparatus 244 sends out electromagnetic interrogation signals periodically through antennas 246 into the secured area 213. Each of the security-sensitive items 240 has attached to it an RFID tag 241, and with these sensitive security documents 240 being in the open, the interrogation signals will reach the RFID tags. Each tag 241 will send a response indicating—"I am in an open area and not in my secured location". Now let us assume that the security-sensitive items 240 are locked in the safe 234 or the file cabinets 236. Then when the interrogation signals are sent out, there will be no reply from the RFID tags 241, and thus the interrogation and monitoring system 244 would recognize this as indicating that the items 240 are in their secured locations.

Let us take now a situation where the authorized personnel are in the building facility and working at their respective desks 232 and various documents 240 are on the desks of these persons. When the noon hour comes and all of the personnel in the secured area 213 are to leave for lunch, all of the security-sensitive items 240 should be placed in either the safe 234 or the locked file cabinets 236. Also the safe 234 and file cabinets 236 should be locked and RFID tags would be operatively connected to the locking mechanisms to indicate either a locked or unlocked condition. At this time the interrogation and control apparatus 244 would be sending out its interrogating signals. If no response signals are received, this would mean that all of the security-sensitive items have been placed in the safe 234 or file cabinets 236, and that these have been locked.

However, let us assume that at the noon hour the interrogation and control apparatus 244 sends out its series of signals to each of the RFID tags 241 and receives a response from one or more of these tags 241, thus indicating that security-sensitive items are left in a non-secured location. When this occurs, the apparatus 244 sends the appropriate alarm signals to initiate precautionary action. This occurs as follows.

As soon as any one of the personnel in the security-sensitive area 213 approaches the exit door 226, a proximity detector 248 recognizes that one or more persons is about to leave the area 213 through the door 226. The proximity detector 248 signals this to the apparatus 244 which immediately sends alert signals to alert the personnel who are about to leave the area through the door 226 to the fact that the area 213 is not secure since some of the documents 240 or other security-sensitive items 240 are left out in the open. This alert signal is telling the personnel not to leave the secured area until proper steps should be taken to make sure these documents or other security-sensitive items 240 are placed either in the safe 234 or the file cabinets 236. When this is accomplished, and when the personnel approach the door 226, there are no such alarms given.

The alarm could be a visual display 250, or an audio alarm 252 (vocalizing words or some sort of other alarm signal), or both. Also, it could be that in addition to giving the alert signals access through the door would either be impeded or blocked in some manner, such as by the apparatus 244 activating a lock 254 on the door. Or there could be a mechanism which would simply impede opening the door 226 to give a physical signal to the personnel that that person should not be leaving the area. If the person would leave the area regardless of these alert signals, then another alarm signal (indicating a more urgent alarm) could be given and appropriate security measures being taken.

Then during the non-working hours, the interrogation and control apparatus 244 could still function to send out its interrogation signals to see if any of these security-sensitive documents 240 are being removed from their security-sensitive locations (either in the safe 234 or the locked file cabinets 236). If this is detected, then this would indicate that there has possibly been a covert entry into the secured area 213 and either the safe or the locked file cabinets 236 have been tampered with.

Other features of this system being described in FIG. 19 are contained in the full text of the other patent application (these naming the same inventors as in the present patent application). Since these are incorporated by reference to such patent application, these will not be repeated in this text.

Figure 20:
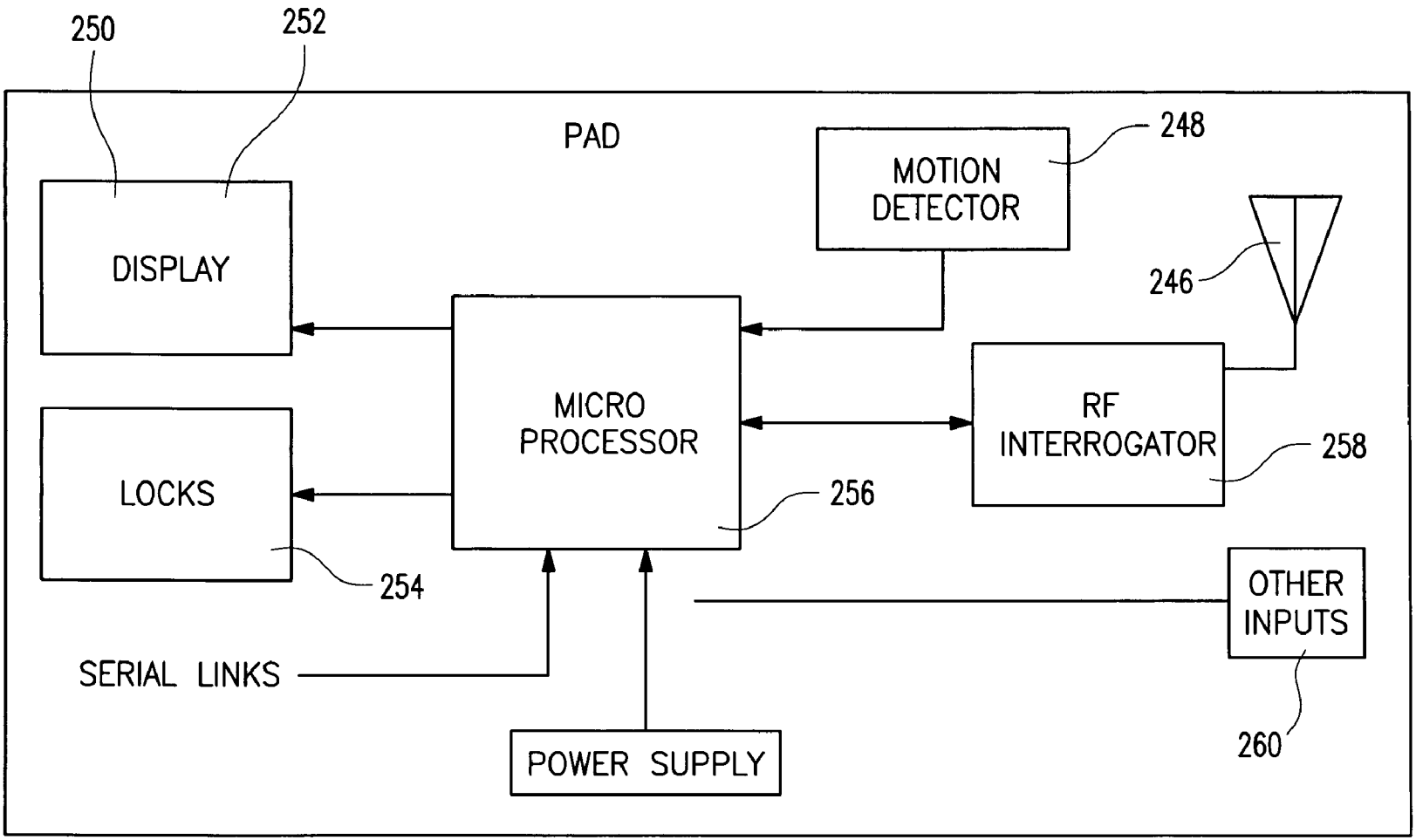
FIG. 20 is a schematic view of the interrogation and control apparatus utilized in the combined system shown in FIG. 19.

Reference is now made to FIG. 20, which shows schematically the main components of the interrogation and control apparatus shown in the other patent application. More specifically, there is indicated the motion detector (or other proximity detector) 248, the two displays 250 and 252, and also the antennas 246 and the lock or locks 254. There is a micro-controller 256 which is operatively connected to the RF interrogator 258 that in turn sends interrogation signals through the antennas 246. The motion detector 244 gives its input to the micro-controller 256 and the response to the interrogation signals come back through the antennas 246, and through the interrogator 258 back to the micro-controller. Other inputs are provided from the various sources, which are indicated schematically and collectively at receiver 260.

As indicated above, this system shown in FIGS. 19 and 20 could be incorporated with the system of the present patent application, since the very same interrogation system and the antennas 246 could be used to send out the interrogation signals as needed, and also to receive the various alarm signals or "I'm okay" signals which would result from utilizing the system of the present invention.

Also, it becomes readily apparent from reviewing the operations of the present invention and also that the system of FIGS. 19 and 20 that these two systems complement each other in that these are directed to related but somewhat different security risks. Thus with these two systems working cooperatively with one another, the overall security of the area is enhanced.

With the system of the present invention and the system from the aforementioned U.S. patent application being combined, the interrogation and control apparatus 244 would also serve the function of the receiver/monitor 59 of the present invention. This interrogation and control apparatus would act as a receiver of signals from those tamper-indicating devices 54 or 60 which are able to generate and transmit the signal without any interrogation. However, for those embodiments of the tamper-indicating devices of the present invention which are passive and respond to an interrogating signal, then the interrogation and control apparatus 244 would be sending the interrogating signals and either be expecting a response or expecting no response for the items that are in the "I'm okay" condition.

In a preferred embodiment, the interrogating signals are sent sequentially and the interrogation is specific to each of the RFID tags or tampering indicating devices that are being monitored. Also the interrogation and control apparatus would have stored at its database the location of each tamper-indicating device (RFID tag) and the item or at least the type of item to which the tamper-indicating device (tag) attached or associated, and also its location. Therefore when the interrogations are made for the tags 241 that are associated with the security-sensitive items 240 (which should be available for interrogation only during certain periods) when the interrogating signals are sent, this would indicate the following.

During those periods where the security-sensitive items 240 are expected to be out of the locked file cabinets 236 or safe 234, then the response would be indicated as a signal indicating "I am present in the area of interrogation and therefore have not yet been taken out of this secured area". Further, if no response is received during the time periods where the items 240 are supposed to be in their secured location, the lack of a signal would indicate that these are in the safe 234 or the locked file cabinets 236. On the other hand a response during these periods where these items 240 are supposed to be securely placed in the file cabinets 236 and 234 would indicate a security risk occurrence.

With regard to the items 242, as indicated above for the some of the tamper-indicating devices, such as the device 54 of the present invention, the interrogation and control apparatus 244 may never receive a signal from those items 242, since they would not have been tampered with and their tamper-indicating devices would remain in the intact position. For other items 242 which have their tamper-indicating devices or RFID tags passive, then a response would be a expected, and this would be a signal indicating "I'm okay; my tamper-responsive section is intact". On the other hand, a lack of a signal in response to an interrogation from the passive RFID tags would indicate that the tamper-indicating device 54 was in its non-intact position and would indicate a possibility of a security risk occurrence.

Figure 21:
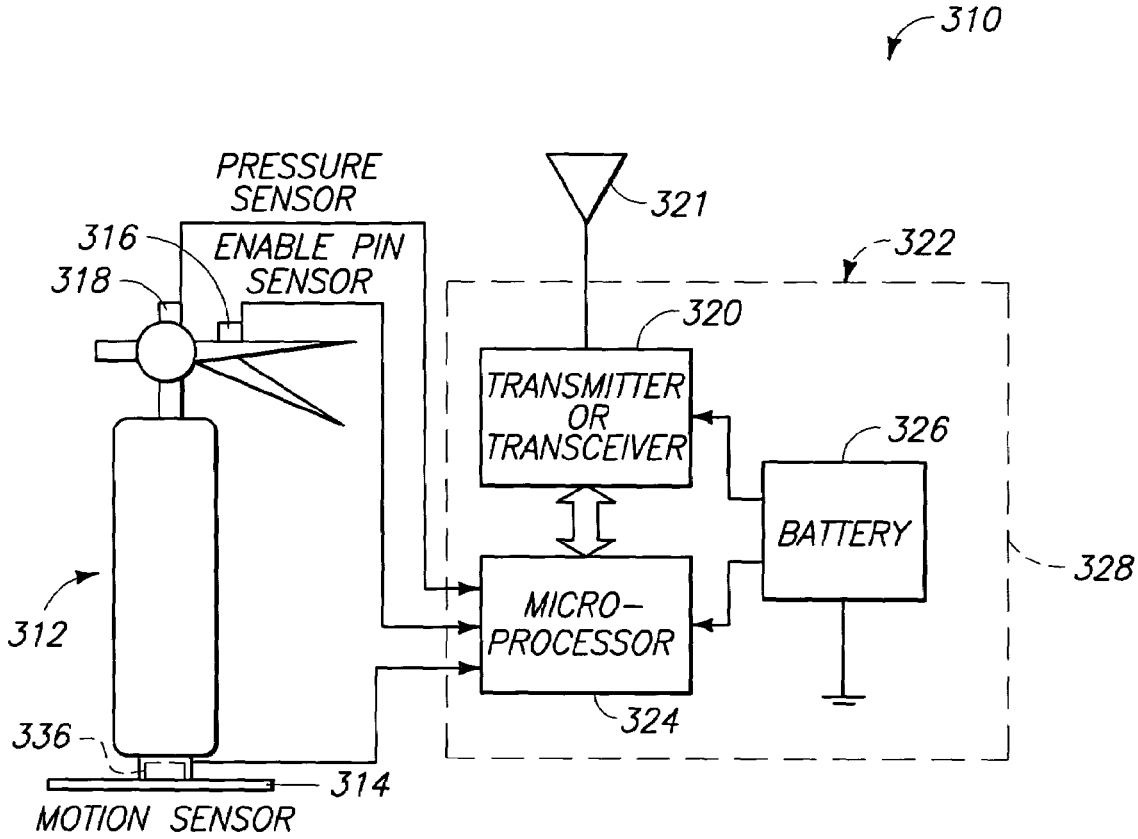
FIG. 21 is a block diagram showing a fire extinguisher, sensors, and a transceiver of the system of FIG. 22.
Figure 22:
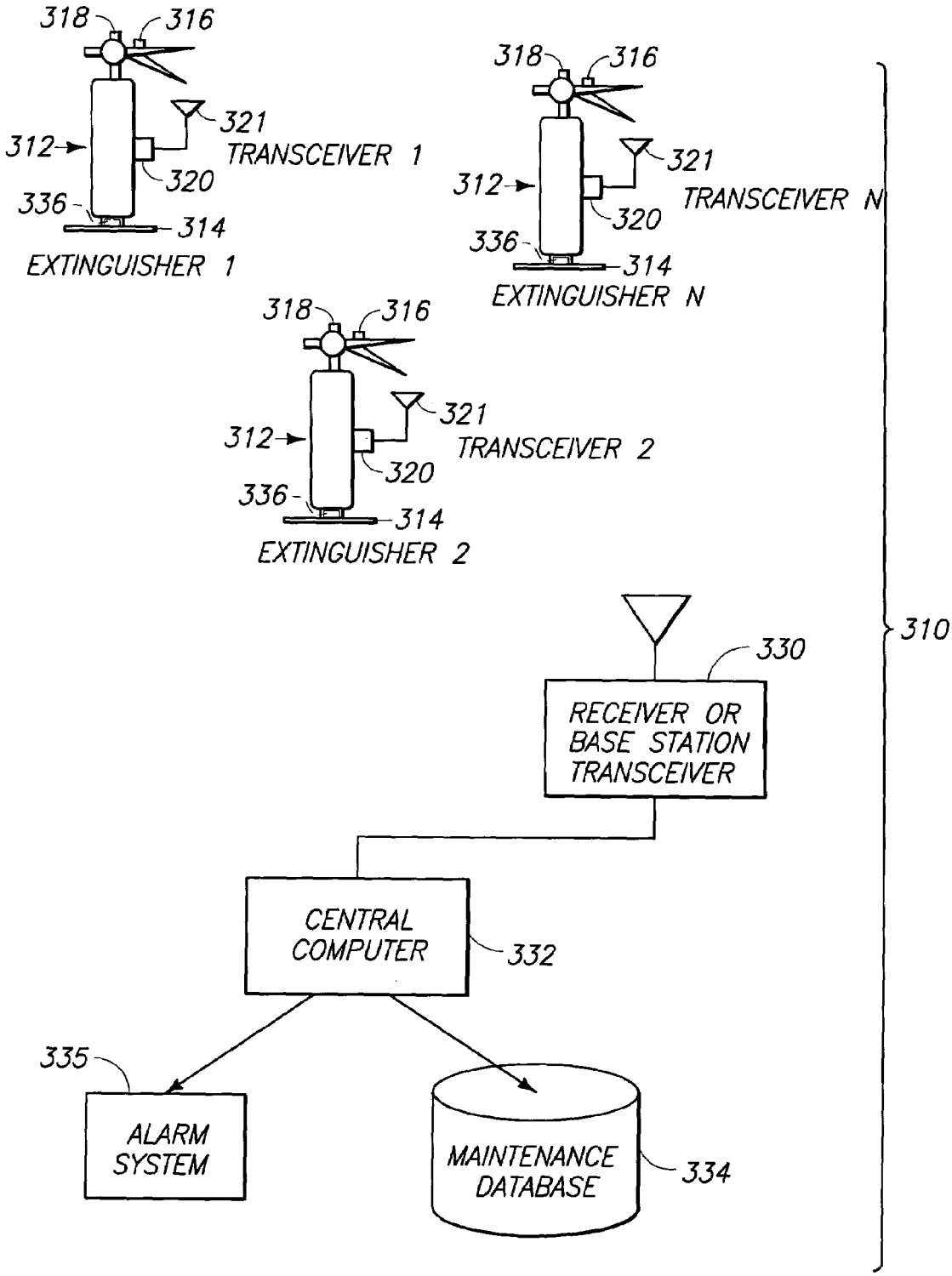
FIG. 22 is a block diagram showing a system embodying various aspects of the invention.

FIGS. 21 and 22 show a system 310, embodying various aspects of the invention, for remotely monitoring the status of multiple fire extinguishers. The system 310 comprises a plurality of sensors adapted to be coupled to respective fire extinguishers 312 in sensing relation to the fire extinguishers 312. The sensors are each configured to sense a parameter of the fire extinguisher 312 to which it is coupled. In the illustrated embodiment, at least some of the fire extinguishers 312 have associated therewith a motion sensor 314 configured to sense if the fire extinguisher is moved.

In some embodiments, one or more fire extinguishers 312 have associated therewith an enable or trigger pin sensor 316 configured to sense if a fire extinguisher enable pin (trigger pin) is removed or tampered with. More particularly, in some embodiments, the trigger pin sensor 316 is defined by a tamper indicating device as described above in connection with FIGS. 5, 5A, 5B, 6A, 6B, 6C, 7, 8, 9, 10, 11, 12 or 13, for example.

Still further, in the illustrated embodiment, at least some of the fire extinguishers 312 have associated therewith a pressure sensor 318 configured to sense fire extinguisher pressure (e.g., to determine if the fire extinguisher 312 is overcharged or undercharged).

The system 310 further includes a plurality of transmitters 320 (and internal or external antennas 321) associated with respective fire extinguishers 312. The term "transmitter," as used herein, is intended to encompass devices that are selectively polled, in a wireless manner, by an interrogator. In some embodiments, the transmitters 320 are defined by transceivers capable of receiving as well as transmitting. The "extinguisher" initiates a communication sequence, using a transmitter 320, when an alarm condition occurs. Each transmitter 320 is associated with or supported from a fire extinguisher 12 and coupled to the sensors 314, 316, and 318 associated with that fire extinguisher 312. The transmitters 320 are each configured to selectively transmit information identifying the fire extinguisher with which the transmitter is associated and to selectively transmit information indicating what the sensors 314, 316, or 318 are sensing. In some embodiments, the transmitters 320 are defined by, for example, a 915 MHz or other band RF transceiver. These are small, inexpensive, systems with a predetermined range (e.g., about 300 feet of range). In addition, they are low enough in power not to require FCC licensing. An example of the type of technology presently available is the uD3 system used to monitor urban power meters. The uD3 system is described at www.udatanet.com.

In some embodiments, at least some of the transmitters 320 are defined by radio frequency identification devices 322 that respectively include transmitter 320, a processor 324 coupled to the transmitter 320, and a battery 326 coupled to the transmitter 320 and processor 324 to supply power to the transmitter 320 and processor 324. Batteries are readily available that can operate the system 310 for over five years, for example, if the extinguishers are polled just a few times each month. A typical battery is, for example, a 3.7 volt 350 mA hour lithium battery.

The radio frequency identification devices 322 each include a common housing 328 supporting or enclosing the transmitter 320, processor 324, and, in some embodiments, the battery 326. The radio frequency identification devices 322 are configured to selectively identify themselves to the receiver. For example, the radio frequency identification devices 322 can be of a design as described in one or more of the following commonly assigned patent applications, which are incorporated herein by reference: U.S. patent application Attorney Ser. No. 10/263,826, filed Oct. 2, 2002, entitled "Radio Frequency Identification Device Communications Systems, Wireless Communication Devices, Wireless Communication Systems, Backscatter Communication Methods, Radio Frequency Identification Device Communication Methods and a Radio Frequency Identification Device" by inventors Michael A. Hughes and Richard M. Pratt; U.S. patent application Ser. No. 10/263,809, filed Oct. 2, 2002, entitled "Method of Simultaneously Reading Multiple Radio Frequency Tags, RF Tag, and RF Reader", by inventors Emre Ertin, Richard M. Pratt, Michael A. Hughes, Kevin L. Priddy, and Wayne M. Lechelt; U.S. patent application Ser. No. 10/263,873, filed Oct. 2, 2002, entitled "RFID System and Method Including Tag ID Compression", by inventors Michael A. Hughes and Richard M. Pratt; U.S. patent application Ser. No. 10/264,078, filed Oct. 2, 2002, entitled "System and Method to Identify Multiple RFID Tags", by inventors Michael A. Hughes and Richard M. Pratt; U.S. patent application Ser. No. 10/263,940, filed Oct. 2, 2002, entitled "Radio Frequency Identification Devices, Backscatter Communication Device Wake-Up Methods, Communication Device Wake-Up Methods and A Radio Frequency Identification Device Wake-Up Method", by inventors Richard Pratt and Michael Hughes; U.S. patent application Ser. No. 10/263,997, filed Oct. 2, 2002, entitled "Wireless Communication Systems, Radio Frequency Identification Devices, Methods of Enhancing a Communications Range of a Radio Frequency Identification Device, and Wireless Communication Methods", by inventors Richard Pratt and Steven B. Thompson; U.S. patent application Ser. No. 10/263,670, filed Oct. 2, 2002, entitled "Wireless Communications Devices, Methods of Processing a Wireless Communication Signal, Wireless Communication Synchronization Methods and a Radio Frequency Identification Device Communication Method", by inventors Richard M. Pratt and Steven B. Thompson; U.S. patent application Ser. No. 10/263,656, filed Oct. 2, 2002, entitled "Wireless Communications Systems, Radio Frequency Identification Devices, Wireless Communications Methods, and Radio Frequency Identification Device Communications Methods", by inventors Richard Pratt and Steven B. Thompson; U.S. patent application Ser. No. 10/263,635, filed Oct. 4, 2002, entitled "A Challenged-Based Tag Authentication Model", by inventors Michael A. Hughes and Richard M. Pratt; U.S. patent application Ser. No. 09/589,001, filed Jun. 6, 2000, entitled "Remote Communication System and Method", by inventors R. W. Gilbert, G. A. Anderson, K. D. Steele, and C. L. Carrender; U.S. patent application Ser. No. 09/802,408; filed Mar. 9, 2001, entitled "Multi-Level RF Identification System"; by inventors R. W. Gilbert, G. A. Anderson, and K. D. Steele; U.S. patent application Ser. No. 09/833,465, filed Apr. 11, 2001, entitled "System and Method for Controlling Remote Device", by inventors C. L. Carrender, R. W. Gilbert, J. W. Scott, and D. Clark; U.S. patent application Ser. No. 09/588,997, filed Jun. 6, 2000, entitled "Phase Modulation in RF Tag", by inventors R. W. Gilbert and C. L. Carrender; U.S. patent application Ser. No. 09/589,000, filed Jun. 6, 2000; entitled "Multi-Frequency Communication System and Method", by inventors R. W. Gilbert and C. L. Carrender; U.S. patent application Ser. No. 09/588,998; filed Jun. 6, 2000, entitled "Distance/Ranging by Determination of RF Phase Delta", by inventor C. L. Carrender; U.S. patent application Ser. No. 09/797,539, filed Feb. 28, 2001, entitled "Antenna Matching Circuit", by inventor C. L. Carrender; U.S. patent application Ser. No. 09/833,391, filed Apr. 11, 2001, entitled "Frequency Hopping RFID Reader", by inventor C. L. Carrender. The advantages of selecting any of the designs are the same as the advantages suggested in the respective patent applications.

In some embodiments, the microprocessor 324 is a simple, low cost, 8-bit micro controller that monitors the three sensors 314, 316, 318 and send/receive commands from the transceiver 320. An ID code is stored in nonvolatile memory of the microprocessor 324, thus uniquely identifying the extinguisher. In some embodiments, additional locations in the nonvolatile memory, or additional memory, is used to store the maintenance record, and location of the extinguisher.

The system 310 further includes a receiver 330 in selective wireless communications with the transmitters 320. In some embodiments, the receiver 330 is defined by a transceiver.

The system 310 further includes a computer 332 coupled to the receiver. In some embodiments, the computer 332 is configured to maintain testing schedules for respective fire extinguishers 312 in, for example, a maintenance database 334. In some embodiments, the computer 332 is configured to provide an output when it is time for an extinguisher 312 to be inspected, tested, and/or undergo maintenance. For example, the computer 332 includes an alarm system 335 defined, for example, by a monitor configured to provide visual information or alerts and/or a speaker configured to provide audible information.

The computer 332 is also configured to selectively store information from a plurality of the transmitters 320. More particularly, the computer is configured to selectively store information from the sensors 314, 316, and 318 coupled to a transmitter 320 as well as information identifying the transmitter 320 and/or the fire extinguisher 312 to which the transmitter 320 is attached. The information is stored, for example, in maintenance database 334.

In some embodiments, the computer 332 contains all of the records also recorded in the individual extinguishers 312 to meet fire protection system standards/requirements. Thus, maintenance records, histories, charging status, etc., are stored in two locations—in the computer 332 and in the memory of the microprocessors 324 associated with the various fire extinguishers 312. In some embodiments, the computer 332 is interfaced to an alarm panel containing a map of the extinguishers location, and thus can indicate when an event occurred, what extinguisher it was, and its location. In some embodiments, operators of the computer 332, such as Safety/Security Managers may use the computer to poll individual extinguishers 312 to ascertain operability of the extinguisher, as well as determine condition/status radio frequency identification device system components, i.e., transmitters 320, transceivers 330, microprocessors 324, and battery units 326. This will permit Safety/Security Managers to be alerted to and address anomalies that may be developing in regard to these system components, prior to a component actually malfunctioning.

In some embodiments, at least one of the transmitters 320 is configured to communicate with the receiver 330 (see FIG. 22) via another of the transmitters 320. More particularly, one or more of the transmitters 320 are configured to communicate in a daisy-chain fashion.

In alternative embodiments, a radio frequency identification device 322 is used to define one of the transmitters 320 and also define a sensor. For example, in one embodiment, a radio frequency identification device 322 is used to define one of the transmitters 320 and also define a sensor 14 to sense if the associated fire extinguisher 312 is moved. In these embodiments, the radio frequency identification device 322 includes a conductor 336 configured to be broken in response to movement of the associated fire extinguisher 312. In some embodiments, the radio frequency identification device 322 includes frangible material including a conductor 336 configured to be broken in response to movement of the associated fire extinguisher 312. The conductor 336 can be arranged in a manner similar to the manner in which conductor 80, 80', etc. is arranged as described above in connection with FIGS. 5, 5A, 5B, 6A, 6B, 6C, 7, 8, 9, 10, 11, 12 or 13, for example.

Thus, a system has been provided that allows for the remote monitoring of fire extinguishing equipment/protection systems within areas governed by standards/requirements established by Underwriters Laboratories, the National Fire Protection Association (NFPA), and/or the Occupational Safety and Health Administration (OSHA). The system helps ensure building/facility Safety/Security Managers are immediately alerted/notified to anomalies relating to tamper, theft, operability of fire extinguishers, and to enhance/ensure the timely inspection, testing, maintenance, management, record keeping of these systems, as well as potential anomalies that may be developing in regard to radio frequency identification devices.

The system makes it possible for Safety/Security Managers to remotely monitor the status of fire extinguishers to help ensure, 1) they are in their designated locations, 2) immediate altering in the event of tampering/theft, 3) immediate alerting in the event an extinguisher's pressure gauge reading/indicator falls below the operable range/position, 4) immediate alerting when an extinguisher is required to undergo scheduled inspection/testing/maintenance, and/or 5) timely record keeping of these systems. Various aspects of the invention provide building/facility Safety/Security Managers a reliable and cost effective way to ensure fire extinguishers are available, serviceable, and operational in the event of an emergency.

A human no longer needs to manually inspect every extinguisher. In addition, should tampering, a loss of pressure, etc., occur, the central computer can immediately indicate an alarm condition. Existing fire extinguishing systems can be retrofitted with the sensor technology disclosed herein.

Because each extinguisher "tag" will has its own unique address, multiple extinguishers can communicate with the central computer, and indeed with each other. Thus, extinguishers can communicate in daisy chain to relay information to their nearest neighbor so that even remote extinguishers can get information to the central computer even though they are out of 300 feet of range, i.e., they only need to be within 300 feet of a tagged extinguisher as long as there is an eventual path to the central computer.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A method of remotely monitoring the status of multiple fire extinguishers, the method comprising:

coupling sensors to respective fire extinguishers in sensing relation to the fire extinguishers, the sensors each being configured to sense a parameter of the fire extinguisher to which it is coupled;

associating transmitters with respective fire extinguishers, the transmitters being configured to selectively transmit information identifying the fire extinguisher with which the transmitter is associated and to selectively transmit information indicative of the sensed parameter;

providing a receiver in selective wireless communications with the transmitters;

providing a computer coupled to the receiver, the computer being configured to maintain testing schedules for respective fire extinguishers and being configured to provide an output when it is time for an extinguisher to be inspected, tested, or undergo maintenance, the computer also being configured to selectively store information from a plurality of the transmitters; and using a radio frequency identification device to define one of the transmitters and to also define a sensor to sense if the associated fire extinguisher is moved, the radio frequency identification device including a conductor configured to be broken in response to movement of the associated fire extinguisher.

2. A method of remotely monitoring the status of multiple fire extinguishers in accordance with claim 1 wherein at least one of the transmitters is configured to communicate with the receiver via another of the transmitters.

3. A method of remotely monitoring the status of multiple fire extinguishers in accordance with claim 1 wherein at least one of the sensors is configured to sense if the associated fire extinguisher is moved.

4. A method of remotely monitoring the status of multiple fire extinguishers in accordance with claim 1 wherein at least one of the sensors is configured to sense movement of a fire extinguisher trigger pin relative to a fire extinguisher trigger.

5. A method of remotely monitoring the status of multiple fire extinguishers in accordance with claim 1 wherein at least one of the sensors is configured to sense fire extinguisher pressure.

6. A method of remotely monitoring the status of multiple fire extinguishers in accordance with claim 1 and further comprising defining at least some of the transmitters using radio frequency identification devices that respectively include a transmitter, a processor coupled to the transmitter, and a battery coupled to supply power to the transmitter and processor, and that are configured to selectively identify themselves to the receiver.

7. A method of remotely monitoring the status of multiple fire extinguishers in accordance with claim 1 and further comprising using a radio frequency identification device to define one of the transmitters and also define a sensor.

8. A method of remotely monitoring the status of multiple fire extinguishers in accordance with claim 1 wherein at least some of the transmitters are defined by transceivers.

9. A system for remotely monitoring the status of a fire extinguisher, the fire extinguisher having a trigger and a trigger pin arranged such that the trigger pin must be removed before the trigger can be operated, the system comprising:

a tamper-indicating device including a tamper-responsive section and a tamper-signaling section, the tamper-responsive section defining a damage-sensitive portion between first and second coupling portions, the damage sensitive portion being in either an intact and a non-intact condition, the first coupling portion being adapted to be coupled to the trigger pin and the second coupling portion being adapted to be coupled external of the trigger pin of the fire extinguisher, the tamper-signaling section being configured to selectively transmit information indicating whether the damage sensitive portion is in the intact or non-intact condition, and the tamper-signaling section including a radio frequency identification device that includes a transmitter, and a processor coupled to the transmitter, and that is configured to selectively identify itself.

10. A system for remotely monitoring the status of a fire extinguisher in accordance with claim 9 wherein the tamper-signaling section is further configured to identify the fire extinguisher.

11. A system for remotely monitoring the status of a fire extinguisher in accordance with claim 9 and further including means for sensing if the fire extinguisher is moved.

12. A system for remotely monitoring the status of a fire extinguisher in accordance with claim 9 and further comprising a second tamper-indicating device including a tamper-responsive section, the tamper-responsive section of the second tamper-indicating device defining a second damage sensitive portion between third and fourth coupling portions, the second damage sensitive portion being in either an intact and a non-intact condition, the third coupling portion being adapted to be coupled to the fire extinguisher and the second coupling portion being adapted to be coupled external of the fire extinguisher.

13. A system for remotely monitoring the status of a fire extinguisher in accordance with claim 12 wherein the second tamper-indicating device includes a tamper-signaling section coupled to the tamper-responsive section of the second tamper-indicating device, the tamper-signaling section of the second tamper-indicating device being configured to selectively transmit information indicating whether the second damage sensitive portion is in the intact or non-intact condition.

14. A system for remotely monitoring the status of a fire extinguisher in accordance with claim 9 and further including means for sensing fire extinguisher pressure.

15. A system for remotely monitoring the status of a fire extinguisher, the fire extinguisher having a trigger and a trigger pin arranged such that the trigger pin must be removed before the trigger can be operated, the system comprising:

a tamper-indicating device including a tamper-responsive section and a tamper-signaling section, the tamper-responsive section defining a damage-sensitive portion between first and second coupling portions, the damage sensitive portion being in either an intact and a non-intact condition, the first coupling portion being adapted to be coupled to the trigger pin and the second coupling portion being adapted to be coupled external of the trigger pin of the fire extinguisher, the tamper-signaling section being configured to selectively transmit information indicating whether the damage sensitive portion is in the intact or non-intact condition, the tamper-signaling section being defined by a radio frequency identification device that includes a transmitter, a processor coupled to the transmitter, and a battery coupled to supply power to the transmitter and processor, and that is configured to selectively identify itself.

16. A system for remotely monitoring the status of a fire extinguisher in accordance with claim 15 wherein the tamper-signaling section is defined by a transceiver.

17. A system for remotely monitoring if a fire extinguisher is moved, the system comprising:

an RF tamper-indicating device including a tamper-responsive section and a transmitting section, the tamper-responsive section defining a damage-sensitive portion between first and second coupling portions, the damage sensitive portion being in either an intact and a non-intact condition, the first coupling portion being adapted to be coupled to the fire extinguisher and the second coupling portion being adapted to be fixed to a surface external of the fire extinguisher, the tamper-signaling section being configured to selectively transmit information indicating whether the damage sensitive portion is in the intact or non-intact condition, the tamper-signaling section including a radio frequency identification device that includes a transmitter, and a processor coupled to the transmitter, and that is configured to selectively identify itself.

18. A system for remotely monitoring if a fire extinguisher is moved in accordance with claim 17 wherein the tamper-signaling section is further configured to identify the fire extinguisher with which the first coupling portion of the tamper-indicating device is coupled.

19. A system for remotely monitoring if a fire extinguisher is moved in accordance with claim 17 and further multiple tamper-indicating devices coupled to respective fire extinguishers, and a common interrogator configured to selectively communicate with the tamper-signaling section of any of the tamper-indicating devices.

20. A system for remotely monitoring if a fire extinguisher is moved in accordance with claim 17 and further including means for sensing fire extinguisher pressure.

21. A system for remotely monitoring if a fire extinguisher is moved, the system comprising:

an RF tamper-indicating device including a tamper-responsive section and a transmitting section, the tamper-responsive section defining a damage-sensitive portion between first and second coupling portions, the damage sensitive portion being in either an intact and a non-intact condition, the first coupling portion being adapted to be coupled to the fire extinguisher and the second coupling portion being adapted to be fixed to a surface external of the fire extinguisher, the tamper-signaling section being configured to selectively transmit information indicating whether the damage sensitive portion is in the intact or non-intact condition; and a second tamper-indicating device including a tamper-responsive section, the tamper-responsive section of the second tamper-indicating device defining a second damage sensitive portion between third and fourth coupling portions, the second damage sensitive portion being in either an intact and a non-intact condition, the third coupling portion being adapted to be coupled to a trigger pin of the fire extinguisher and the second coupling portion being adapted to be coupled to a fixed surface external of the trigger pin of the fire extinguisher, the second tamper-indicating device including a tamper-signaling section coupled to the tamper-responsive section of the second tamper-indicating device, the tamper-signaling section of the second tamper-indicating device being configured to selectively transmit information indicating whether the second damage sensitive portion is in the intact or non-intact condition.

22. A system for remotely monitoring if a fire extinguisher is moved in accordance with claim 21 and further comprising a common interrogator configured to selectively communicate with the tamper-signaling section of either of the tamper-indicating devices.

23. A system for remotely monitoring if a fire extinguisher is moved, comprising:

an RF tamper-indicating device including a tamper-responsive section and a transmitting section, the tamper-responsive section defining a damage-sensitive portion between first and second coupling portions, the damage sensitive portion being in either an intact and a non-intact condition, the first coupling portion being adapted to be coupled to the fire extinguisher and the second coupling portion being adapted to be fixed to a surface external of the fire extinguisher, the tamper-signaling section being configured to selectively transmit information indicating whether the damage sensitive portion is in the intact or non-intact condition, the tamper-signaling section being defined by a radio frequency identification device that includes a transmitter, a processor coupled to the transmitter, and a battery coupled to supply power to the transmitter and processor, and that is configured to selectively identify itself.

24. A system for remotely monitoring if a fire extinguisher is moved in accordance with claim 23 wherein the radio frequency identification device includes a transceiver.

25. A method of remotely monitoring the status of multiple fire extinguishers, the method comprising:

associating transceivers with respective fire extinguishers, with at least some of the transceivers configured to cause an alarm signal in response to a fire extinguisher being moved, and with at least some of the transceivers configured to cause an alarm signal in response to extinguisher pressure below a predetermined threshold, the transceivers being configured to store and selectively transmit information identifying the fire extinguisher with which the transceiver is associated;

providing an interrogator in selective wireless communication with the transceivers;

providing a computer coupled to the interrogator, the computer being configured to maintain inspection, testing, maintenance schedules for respective fire extinguishers and being configured to provide an output when it is time for an extinguisher to be inspected, the computer also being configured to provide an output in response to an alarm signal being generated and using radio frequency identification devices to define at least some of the transceivers and to also define sensors to sense if the associated fire extinguisher is moved, respective radio frequency identification devices including a frangible wire configured to be broken in response to movement of the associated fire extinguisher.

26. A method of remotely monitoring the status of multiple fire extinguishers in accordance with claim 25 wherein at least one of the transponders is configured to communicate with the computer via another of the transponders.

27. A method of remotely monitoring the status of multiple fire extinguishers in accordance with claim 25 wherein associating transceivers comprises configuring at least one of the transceivers to send an alarm signal in response to the associated fire extinguisher being moved.

28. A method of remotely monitoring the status of multiple fire extinguishers in accordance with claim 25 and further comprising defining the transceivers using radio frequency identification devices that respectively include a transceiver, a processor coupled to the transceiver, and a battery coupled to supply power to the transceiver and processor, and that are configured to identify themselves to the computer.

29. A method of remotely monitoring the status of multiple fire extinguishers in accordance with claim 25 wherein a plurality of transponders are configured to communicate with the computer via another of the transponders.

30. A system for remotely monitoring the status of multiple fire extinguishers, the system comprising:

transceivers configured to be associated with respective fire extinguishers, with at least some of the transceivers including a frangible wire configured to break and cause an alarm signal in response to a fire extinguisher being moved, and with at least some of the transceivers configured to cause an alarm signal in response to extinguisher pressure below a predetermined threshold, the transceivers being configured to store and selectively transmit information identifying the fire extinguisher with which the transceiver is associated;

an interrogator in selective wireless communication with the transceivers; and a computer coupled to the interrogator, the computer being configured to maintain inspection, testing, or maintenance schedules for respective fire extinguishers and being configured to provide an output when it is time for an extinguisher to be inspected, tested, or undergo maintenance, the computer also being configured to provide an output in response to an alarm signal being generated, the transceivers being defined using radio frequency identification devices that respectively include a transceiver, and a processor coupled to the transceiver, and that are configured to identify themselves to the computer.

31. A system for remotely monitoring the status of multiple fire extinguishers in accordance with claim 30 wherein at least one of the transponders is configured to communicate with the computer via another of the transponders.

32. A system for remotely monitoring the status of multiple fire extinguishers in accordance with claim 30 wherein at least one of the transceivers is configured to send an alarm signal in response to the associated fire extinguisher being moved.

33. A system for remotely monitoring the status of multiple fire extinguishers, comprising:

transceivers configured to be associated with respective fire extinguishers, with at least some of the transceivers including a frangible wire configured to break and cause an alarm signal in response to a fire extinguisher being moved, and with at least some of the transceivers configured to cause an alarm signal in response to extinguisher pressure below a predetermined threshold, the transceivers being configured to store and selectively transmit information identifying the fire extinguisher with which the transceiver is associated, the transceivers being defined using radio frequency identification devices that respectively include a transceiver, a processor coupled to the transceiver, and a battery coupled to supply power to the transceiver and processor, and that are configured to identify themselves to the computer;

an interrogator in selective wireless communication with the transceivers; and a computer coupled to the interrogator, the computer being configured to maintain inspection, testing, or maintenance schedules for respective fire extinguishers and being configured to provide an output when it is time for an extinguisher to be inspected, tested, or undergo maintenance, the computer also being configured to provide an output in response to an alarm signal being generated.

34. A system for remotely monitoring the status of multiple fire extinguishers in accordance with claim 33 wherein at least one of the transponders is configured to communicate with the computer via another of the transponders.

35. A system for remotely monitoring the status of multiple fire extinguishers, the system comprising:

sensors configured to sense removal, or tampering, of trigger pins of respective fire extinguishers;

wireless transmitters coupled to respective sensors and configured to selectively transmit whether the trigger pin of the respective fire extinguisher has been removed or tampered with, the wireless transmitters being defined by respective radio frequency identification devices that respectively include a transmitter, and a processor coupled to the transmitter; and a receiver configured to selectively receive the transmissions for the multiple fire extinguishers at a common location, the receiver being defined by an interrogator, and the radio frequency identification devices beinq configured to selectively identify themselves to the interrogator in response to an interrogation signal from the interrogator.

36. A system for remotely monitoring the status of multiple fire extinguishers in accordance with claim 35 and further comprising a computer coupled to the receiver and configured to maintain inspection, testing, and maintenance schedules for the respective fire extinguishers and to provide a signal when it is time for one of the fire extinguishers to be tested.

37. A system for remotely monitoring the status of multiple fire extinguishers in accordance with claim 35 and further comprising a sensor, coupled to one of the wireless transmitters, configured to sense if one of the fire extinguishers is moved.

38. A system for remotely monitoring the status of multiple fire extinguishers in accordance with claim 36 and further comprising a sensor, coupled to one of the wireless transmitters, configured to sense fire extinguisher pressure.

39. A system for remotely monitoring the status of multiple fire extinguishers, the system comprising:

sensors configured to sense removal, or tampering, of tripper pins of respective fire extinguishers;

wireless transmitters coupled to respective sensors and configured to selectively transmit whether the trigger pin of the respective fire extinguisher has been removed or tampered with, the wireless transmitters being defined by respective radio frequency identification devices that each include a transmitter, a processor coupled to the transmitter, and a battery coupled to supply power to the transmitter and processor; and a receiver configured to selectively receive the transmissions for the multiple fire extinguishers at a common location, the receiver being defined by an interrogator, and the radio frequency identification devices being configured to selectively identify themselves to the interrogator in response to an interrogation signal from the interrogator.

* * * * *

UNITED STATES PATENT AND TRADEMARK OFFICE

CERTIFICATE OF CORRECTION

PATENT NO. : 7,081,815 B2
APPLICATION NO. : 10/669669
DATED : July 25, 2006
INVENTOR(S) : Runyon et al.

It is certified that error appears in the above-identified patent and that said Letters Patent is hereby corrected as shown below:

Col. 7, line 43, please delete "25" after "and".

Col. 10, line 52, please delete "and" after "5B".

Col. 12, line 26, please delete "or" after "but" and insert --are--.

Col. 14, line 13, please delete "embodiment" after "earlier" and insert --embodiments--.

Col. 15, line 56, please delete "25" after "in the".

Col. 20, line 45, please delete "a" after "would be".

Col. 21, line 19, please delete "12" after "extinguisher" and insert --312--.

Col. 21, line 52, please delete "Attorney" after "application".

Col. 24, line 27, please delete "has" after "will" and insert --have--.

Signed and Sealed this

Fourth Day of November, 2008

JON W. DUDAS
*Director of the United States Patent and Trademark Office*